US006637578B1

(12) United States Patent
Ono et al.

(10) Patent No.: US 6,637,578 B1
(45) Date of Patent: Oct. 28, 2003

(54) COIN PROCESSING DEVICE

(75) Inventors: Takashi Ono, Saitama (JP); Kenji Nakajima, Saitama (JP); Shinichi Kosugi, Tsurugashima (JP); Mitsugu Mikami, Kawagoe (JP)

(73) Assignee: Kabushiki Kaisha Nippon Conlux (JP)

( * ) Notice: Subject to any disclaimer, the term of this patent is extended or adjusted under 35 U.S.C. 154(b) by 240 days.

(21) Appl. No.: 09/723,807

(22) Filed: Nov. 28, 2000

(30) Foreign Application Priority Data

Nov. 30, 1999 (JP) ..... 11/341099

(51) Int. Cl.[7] ..... G07D 3/00
(52) U.S. Cl. ..... 194/346; 453/3
(58) Field of Search ..... 194/346, 342, 194/217; 453/3, 4

(56) References Cited

U.S. PATENT DOCUMENTS 5,184,709 A * 2/1993 Nishiumi et al. ..... 453/3 X
5,950,795 A * 9/1999 Kojima ..... 194/346 X

FOREIGN PATENT DOCUMENTS

| | | |
|---|---|---|
| JP | 49-96799 | 9/1974 |
| JP | 50-34596 | 4/1975 |
| JP | 51-84590 | 7/1976 |
| JP | 52-49099 | 4/1977 |
| JP | 52-61395 | 5/1977 |
| JP | 52-61396 | 5/1977 |
| JP | 52-61397 | 5/1977 |
| JP | 52-69398 | 6/1977 |
| JP | 52-70895 | 6/1977 |
| JP | 52-73796 | 6/1977 |
| JP | 51-140392 | 10/1977 |
| JP | 53-40600 | 4/1978 |
| JP | 57-62480 | 4/1982 |
| JP | 57-113194 | 7/1982 |

* cited by examiner

*Primary Examiner*—James R. Bidwell
(74) *Attorney, Agent, or Firm*—Greer, Burns & Crain, Ltd.

(57) ABSTRACT

A coin detaining portion for temporarily detaining inserted coins passing through a coin sorting passage is situated adjacent to the denomination separating portion situated at the farthest upstream location of the coin sorting passage having arranged therein a plurality of denomination separating portions for separating inserted coins identified as genuine into different coin passages on the basis of their denomination.

5 Claims, 17 Drawing Sheets

COIN PROCESSING DEVICE

BACKGROUND OF THE INVENTION

1. Field of the Invention

The present invention relates to a coin processing device used in vending machines, money exchangers, service devices, etc., and adapted to sort and accommodate inserted coins by denomination, and dispense as change coins so sorted and accommodated.

2. Description of the Related Art

Vending machines, money exchangers, service devices, etc., are equipped with coin processing devices for sorting and accommodating inserted coins by denomination, and dispensing these coins as change.

Such coin processing devices generally comprise the following four portions.

(1) A device main body constituting the housing of the coin processing device.

(2) A coin sorting portion, located in the uppermost portion of the device main body, for determining whether inserted coins are genuine, and sorting genuine coins by denomination.

(3) A coin accommodating portion, located within the device main body below the coin sorting portion, that comprises a plurality of tubes for accommodating by denomination genuine coins that have been sorted by the coin sorting portion.

(4) A coin dispensing portion, located within the device main body below the coin accommodating portion, for dispensing as change coins accommodated in the coin accommodating portion.

Vending machines equipped with coin processing devices of this kind are designed such that when a product purchaser, having deposited coins with the intent of purchasing a product, subsequently decides for some reason to terminate product purchase, and desires the coins to be returned, may operate a coin return lever provided to the vending machine.

At this point, the coin processing device returns coins of the same amount of money as that of the inserted coins through a coin return slot, so that the product purchaser desiring return of the inserted coins may recover the returned coins from the coin return slot.

In the typical coin processing device described above, a coin return process is activated by operation of the coin return lever, which causes the coin dispensing portion to dispense coins of the same amount as the inserted coins from the coin accommodating portion to the coin return slot.

Thus, in a typical coin processing device, during a coin return process the actual coins inserted by the product purchaser are not returned to the coin return slot, but rather coins having the corresponding amount to the inserted coins are dispensed from the coins already accommodated in the coin accommodating portion.

In this way, when inserted coins are returned by a conventional coin processing device, the actual inserted coins are not returned, but rather coins of the same amount as the inserted coins are dispensed from coins already accommodated in the coin accommodating portion. Accordingly, supposing that a counterfeit coin good enough to pass as genuine in the coin sorting portion were to be inserted into the coin processing device, and the coin return lever were then operated without a product purchase: despite the fact that the inserted coin is counterfeit, a genuine coin having the corresponding amount to the inserted coin is dispensed to the coin return slot, resulting in a so-called "coin switching."

In order to foil coin switching, there has been disclosed in the past, e.g., in Unexamined Japanese Patent Publication (Kokai) 11-288480, providing a coin detaining lever situated at the downstream end of a coin sorting passage having a plurality of denomination separation levers for separating by denomination coins considered to be genuine, i.e., at the downstream end of the coin sorting passage in which coins are ultimately separated and guided by denomination. An inserted coin is temporary detained by this coin detaining lever, and in the event that the coin return lever is operated without a product purchase, the inserted coin temporary detained by the coin detaining lever is released so that the inserted coin is dispensed from the coin return slot.

Coin processing devices of this type, wherein in the event that the coin return lever is operated without a product purchase, an inserted coin temporary detained by a coin detaining lever is released so that the actual inserted coin is dispensed from the coin return slot, are known as actual coin return type coin processing devices.

According to the actual coin return type coin processing device disclosed in Unexamined Patent Publication (Kokai) 11-288480, when a coin is returned through operation of the coin return lever, the actual inserted coin is dispensed. Thus, in the event that a counterfeit coin good enough to pass as genuine in the coin sorting portion were to be inserted, since the inserted (counterfeit) coin itself is returned to the coin return slot, coin switching is effectively thwarted.

Where a vending machine employing a coin processing device of the conventional type described above (Unexamined Patent Publication (Kokai) 11-288480) is used to vend an expensive product the purchase of which requires a plurality of coins, a coin passage provided with a coin detaining lever is used to temporarily hold the plurality of inserted coins.

In the event that the coin return lever is operated without a product purchase in the manner described earlier, the inserted coins temporarily detained by the coin detaining lever are released, and the plurality of inserted coins temporarily detained in the coin passage provided with the coin detaining lever are dispensed to the coin return slot.

In response to the increasing diversity of vended products, vending machines must now be able to vend expensive products the purchase of which requires a large number of coins.

Where the conventional actual coin return type coin processing device described above (Unexamined Patent Publication (Kokai) 11-288480) is used in such a case, namely, in a vending machine for vending expensive products the purchase of which requires a large number of coins, since the design of the coin processing device is such that a plurality of inserted coins are temporarily detained in a coin passage provided with a coin detaining lever, the number of coins that can be temporarily detained is limited by the length per se of the coin passage wherein the coin detaining lever is arranged. Accordingly, it is difficult to adapt the conventional actual coin return type coin processing device to temporarily hold a greater number of inserted coins, and thus to vend more expensive products.

SUMMARY OF THE INVENTION

With the foregoing in view, it is an object of the invention to provide a coin processing device capable of temporarily holding a greater number of inserted coins and, in the event that the coin return lever is operated without a product purchase, of dispensing this plurality of inserted coins to the coin return slot.

In the present invention, the aforementioned problem is solved by a coin processing device comprising a coin sorting passage in which are arranged a plurality of denomination separating portions for separating inserted coins identified as genuine into different coin passages based on their denomination, and a coin detaining portion for temporarily detaining the inserted coins passing through the coin sorting passages, wherein the coin detaining portion is situated adjacent to one of the plurality of denomination separating portions arranged in the coin sorting passages, the one of the denomination separating portions being situated at farthest upstream location than any other denomination separating portions.

DESCRIPTION OF THE PREFERRED EMBODIMENTS

An embodiment of the coin processing device of the invention is now described.

Figure 1:
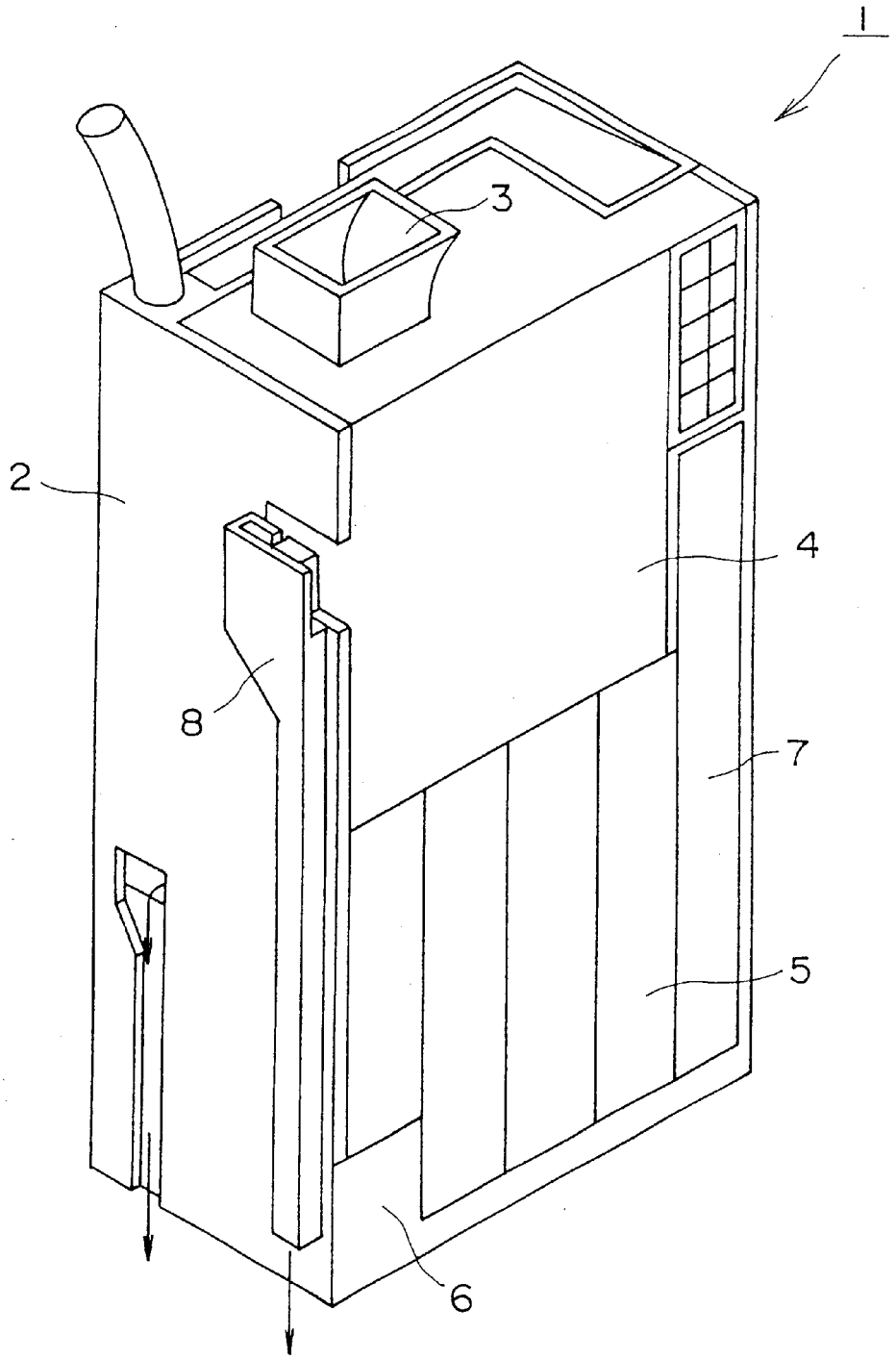
FIG. 1 is a schematic perspective view of a coin processing device according to this invention.

FIG. 1 is a schematic perspective view of a coin processing device 1 according to the invention.

As in the conventional coin processing device, this coin processing device 1 generally comprises the following four portions.

Namely, this coin processing device 1 likewise comprises a device main body 2 constituting a housing; a coin sorting portion 4 located in the uppermost portion of the device main body 2, for determining whether an inserted coin inserted into a coin insertion slot 3 is genuine and sorting genuine coins by denomination; a coin accommodating portion 5 located below the coin sorting portion 4, comprising a plurality of coin tubes for accommodating by denomination genuine coins that have been sorted by the coin sorting portion 4; and a coin dispensing portion 6 located below the coin accommodating portion 5, for dispensing the required change from genuine coins accommodated in the coin accommodating portion 5.

Reference numeral 7 in FIG. 1 is a supplementary tube for accommodating coins used especially frequently, and reference numeral 8 is a liquid discharge tube for discharging from the coin processing device 1 any liquid that has penetrated therein (a liquid such as a cleanser, etc.).

The coin sorting portion 4 of the coin processing device 1 is now described.

Figure 2:
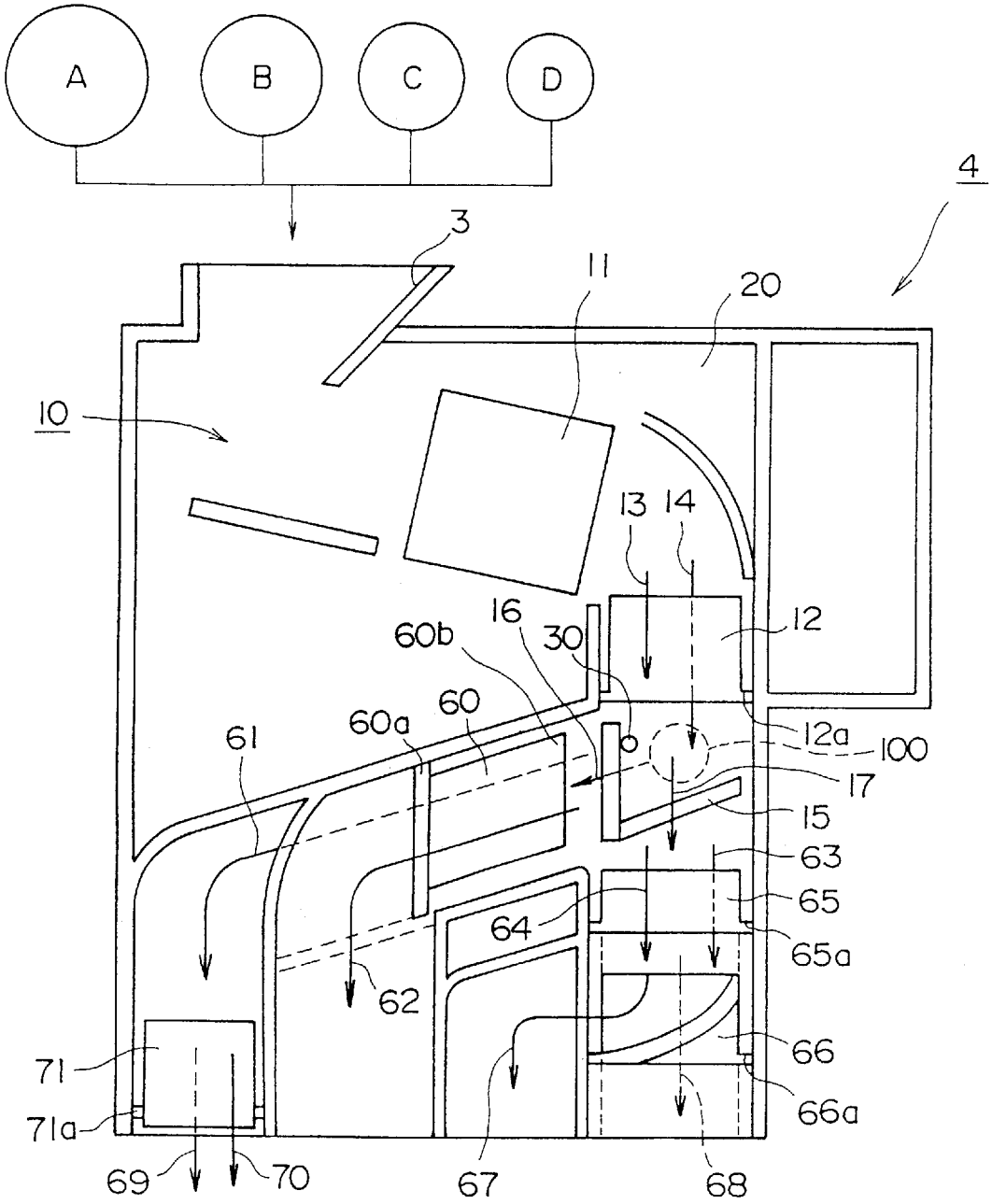
FIG. 2 is a schematic front view showing the coin sorting portion of the coin processing device according to this invention.

FIG. 2 is a schematic front view of coin sorting portion 4.

This coin sorting portion 4 performs sorting of four genuine coins A, B, C, and D, whose diameters are fundamentally different from one another, and counterfeit coins.

A genuine/counterfeit coin identifying passage 10 inclined rightward in the drawing is located immediately below the coin insertion slot 3 of the coin sorting portion 4. A genuine/counterfeit coin identifying sensor 11 for identifying genuine and counterfeit coins and the denomination of genuine coins is situated at a medial location therein.

At the terminus of the genuine/counterfeit coin identifying passage 10 is situated a genuine/counterfeit coin separating lever 12 (genuine/counterfeit coin separating portion) for separating coins transferred thereto from the genuine/counterfeit coin identifying passage 10 into genuine coins and counterfeit coins, and guiding genuine coins and counterfeit coins into different coin passages.

This genuine/counterfeit coin separating lever 12 is a separating lever of a type that opens and closes at the upper end thereof in a direction perpendicular to the plane of the drawing about a shaft 12*a* situated at lower end thereof.

The terminus of the genuine/counterfeit coin identifying passage 10 is divided by means of this genuine/counterfeit coin separating lever 12 into a counterfeit coin ejection coin passage 13 for guiding only inserted coins determined to be counterfeit, and a first coin sorting passage 14 for guiding only coins determined to be genuine.

At the downstream end of this first coin sorting passage 14 there is arranged a first denomination separating lever 15 (first denomination separating portion) for separating coins determined to be genuine and transferred to the first coin sorting passage 14 (namely, the four types of genuine coins A, B, C, and D) into a coin A/C group and a coin B/D group. At a location adjacent to this first denomination separating lever 15 there is arranged a coin detaining lever 30 (coin detaining portion) capable of temporarily holding inserted coins of all denominations identified as genuine as these pass through the first coin sorting passage 14 which pertains to the invention.

The first coin sorting passage 14 is divided by the first denomination separating lever 15 into a second coin sorting passage 16 (which slopes to the left in the drawing) for guiding only coins of the A/C group, and a third coin sorting passage 17 which extends downward in the drawing, for guiding guides only coins of the B/D group.

As shown in FIG. 2, the overall configuration of the first denomination separating lever 15 is "L" shaped when viewed from the front.

Figure 3:
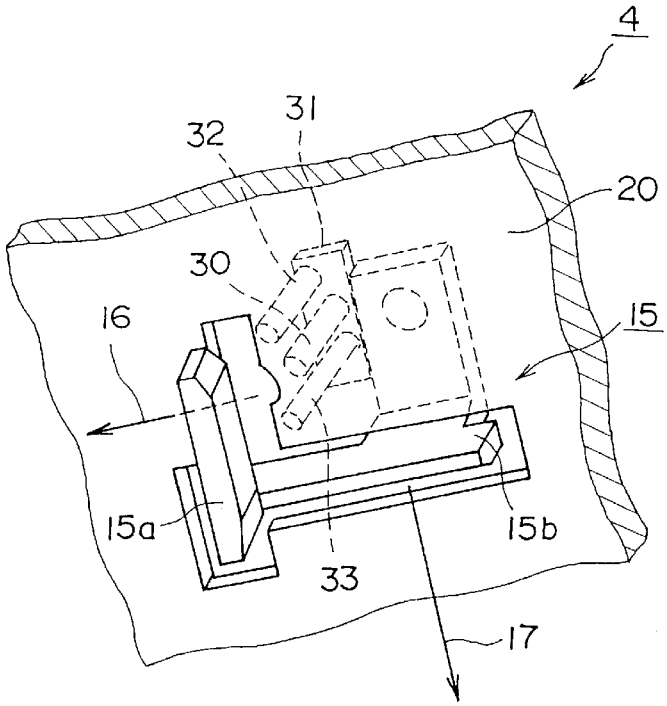
FIG. 3 is a fragmentary perspective view showing the coin detaining portion.
Figure 4:
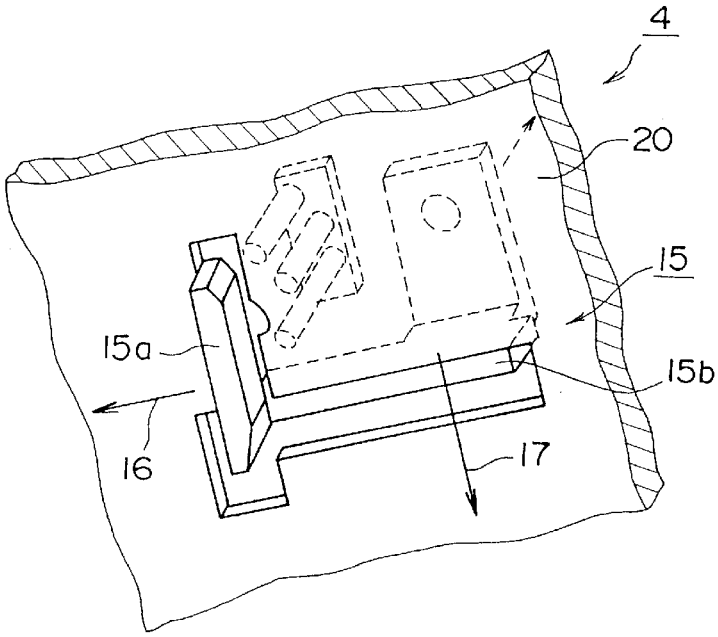
FIG. 4 is a fragmentary perspective view showing the coin detaining portion.

As shown in fragmentary perspective view in FIG. 3, this first denomination separating lever 15 comprises a first gate 15*a* that when projected from the surface of the main plate 20 of coin sorting portion 4 opens the second coin sorting passage 16 situated to the side, and that when drawn towards the main plate 20 in the manner depicted in FIG. 4 blocks off the second coin sorting passage 16; and a second gate 15*b* that when projected from the main plate 20 in the manner depicted in FIG. 3 blocks off the third coin sorting passage 17 situated on the bottom face, and when drawn towards the main plate 20 in the manner depicted in FIG. 4 opens the third coin sorting passage 17.

In this way, by means of the first denomination separating lever 15, when the first denomination separating lever 15 is projected from the surface of the main plate 20 in the manner depicted in FIG. 3, the second coin sorting passage 16 opens and the third coin sorting passage 17 is blocked off, so that only coins of the A/C group are guided into the second coin sorting passage 16 which slopes to the left in the drawing.

When the first denomination separating lever 15 is drawn towards the main plate 20 in the manner depicted in FIG. 4, the second coin sorting passage 16 is blocked and the third coin sorting passage 17 is opened, so that only coins of the B/D group are guided into the third coin sorting passage 17 situated below.

Referring to FIG. 3, the coin detaining lever 30 (coin detaining portion) is retractably provided at a location adjacent to the first gate 15*a*, which is a portion of the first denomination separating lever 15, and opens and blocks the second coin sorting passage 16.

This coin detaining lever 30 comprises a metal pin implanted in a base lever 31. A pair of gate holding levers 32, 33 (gate holding portions), described later, are implanted in base lever 31, adjacent to the coin detaining lever 30.

The coin detaining lever 30 and the pair of gate holding levers 32, 33 are protruded and retracted vis-à-vis the surface of main plate 20 by means of detaining portion drive means, described later.

Figure 5:
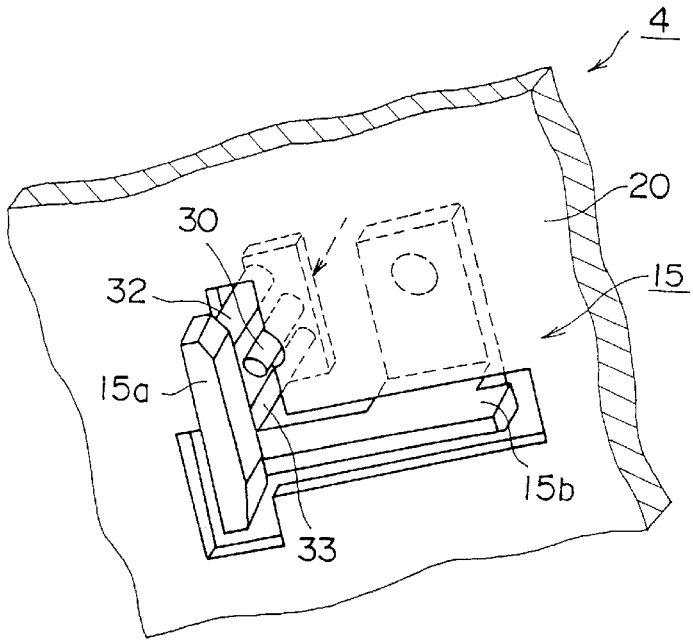
FIG. 5 is a fragmentary perspective view showing operation of the coin detaining portion.
Figure 6:
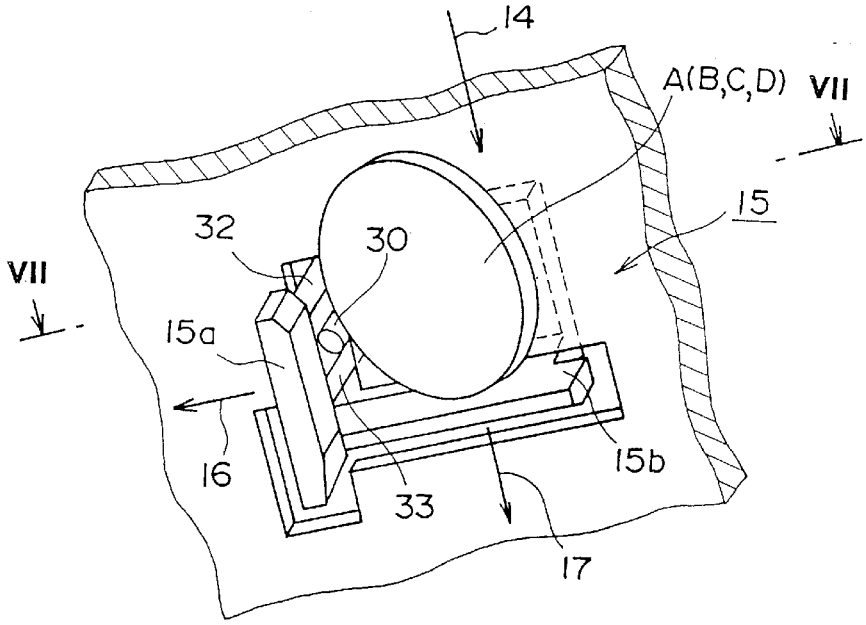
FIG. 6 is a fragmentary perspective view showing operation of the coin detaining portion.

Accordingly, from the initial position of first denomination separating lever 15 shown in FIG. 3, when coin detaining lever 30 and the pair of gate holding levers 32, 33 are projected from surface of main plate 20, the pair of gate holding levers 32, 33 support the back face of the first gate 15*a* of first denomination separating lever 15 in the manner depicted. in FIG. 5 so at to restrict front-to-back movement of the first denomination separating lever 15, and the coin detaining lever 30 projects into the upstream end of the second coin sorting passage 16, so that all coins A, B, C, and D identified as genuine by the genuine/counterfeit separating lever 12 and passed through the downstream end of the first coin sorting passage 14, shown in FIG. 2, are halted by the second gate 15*b* of the first denomination separating lever 15 and by the coin detaining lever 30, and temporarily detained at the terminus of the first coin sorting passage 14, as shown in FIG. 6.

The detaining portion drive means for protruding and retracting the coin detaining lever 30 and the pair of gate holding levers 32, 33 vis-à-vis the surface of the main plate 20 is now described.

Figure 7:
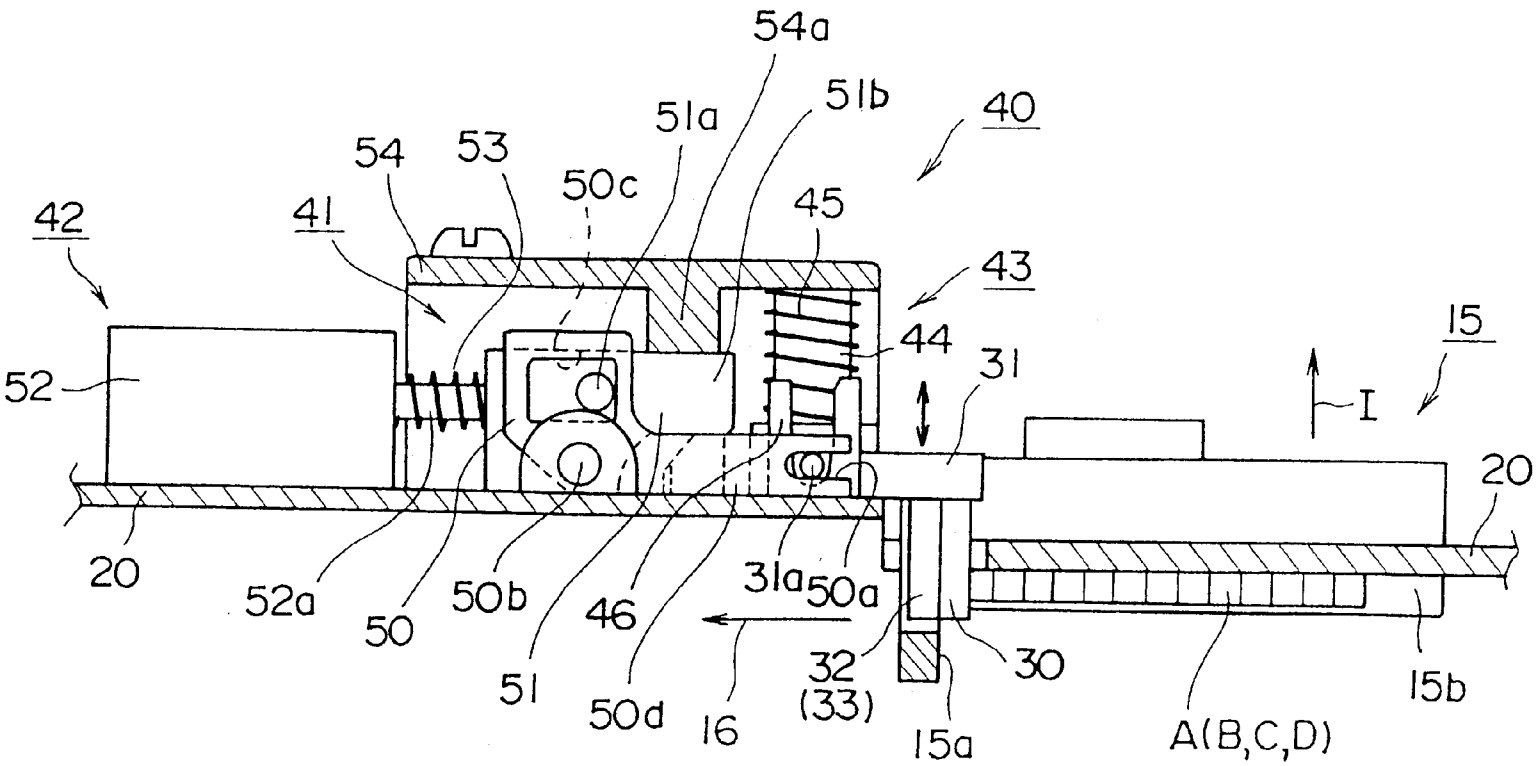
FIG. 7 is an enlarged sectional view of the detaining portion drive means, which is taken along line VII—VII in FIG. 6.

FIG. 7 is an enlarged sectional view taken along line VII—VII in FIG. 6. A detaining portion drive means 40 comprises link means 41 for perpendicularly protruding the base portion 31, in which are implanted the coin detaining lever 30 and the pair of gate holding levers 32, 33, from the main plate 20; link drive means 42 for driving this link means 41; and guide means 43 for guiding the base portion 31 perpendicularly with respect to the main plate 20.

Guide means 43 comprises a cylindrical post 44 projecting upward from main plate 20 and fitting into base portion 31, for guiding base portion 31 perpendicularly with respect to the main plate 20; a coil spring 45 fitted around cylindrical post 44, for urging base portion 31 towards main plate 20; and a pair of notch bodies 46 for preventing the base portion 31 from turning about the cylindrical post 44. A pair of guide projections 31*a* projecting from the sides of base portion 31 fit into the pair of notch bodies 46.

The link means 41 comprises a pair of guide arms 50, each rotatably supported about a shaft 50*b* and having a guide slot 50*a* into which fits one of the pair of guide projections 31 a projecting from the sides of base portion 31.

Link drive means 42, described next, is coupled to the back end of this guide arm 50.

This link drive means 42 comprises a slider 51 with projections 51*a* each fitting into one of a pair of rectangular link holes 50*c* formed in the back ends of guide arms 50, and a solenoid 52 for sliding the slider 51 in the left-to-right direction in the drawing. Slider 51 is coupled with the drive shaft 52*a* of solenoid 52, and slider 51 is halted in the initial position depicted in the drawing by the urging force of a coil spring 53 fitted onto this drive shaft 52*a*.

In this initial position, the fore end 51*b* of slider 51 is held between a guide projection 54*a*, which projects from the bottom face of a cover 54 attached to the main plate 20, and a guide projection 50*d* formed between the pair of guide arms 50, thereby preventing movement thereof in the vertical direction in the drawing, namely, perpendicular movement vis-à-vis the main plate 20.

Figure 8:
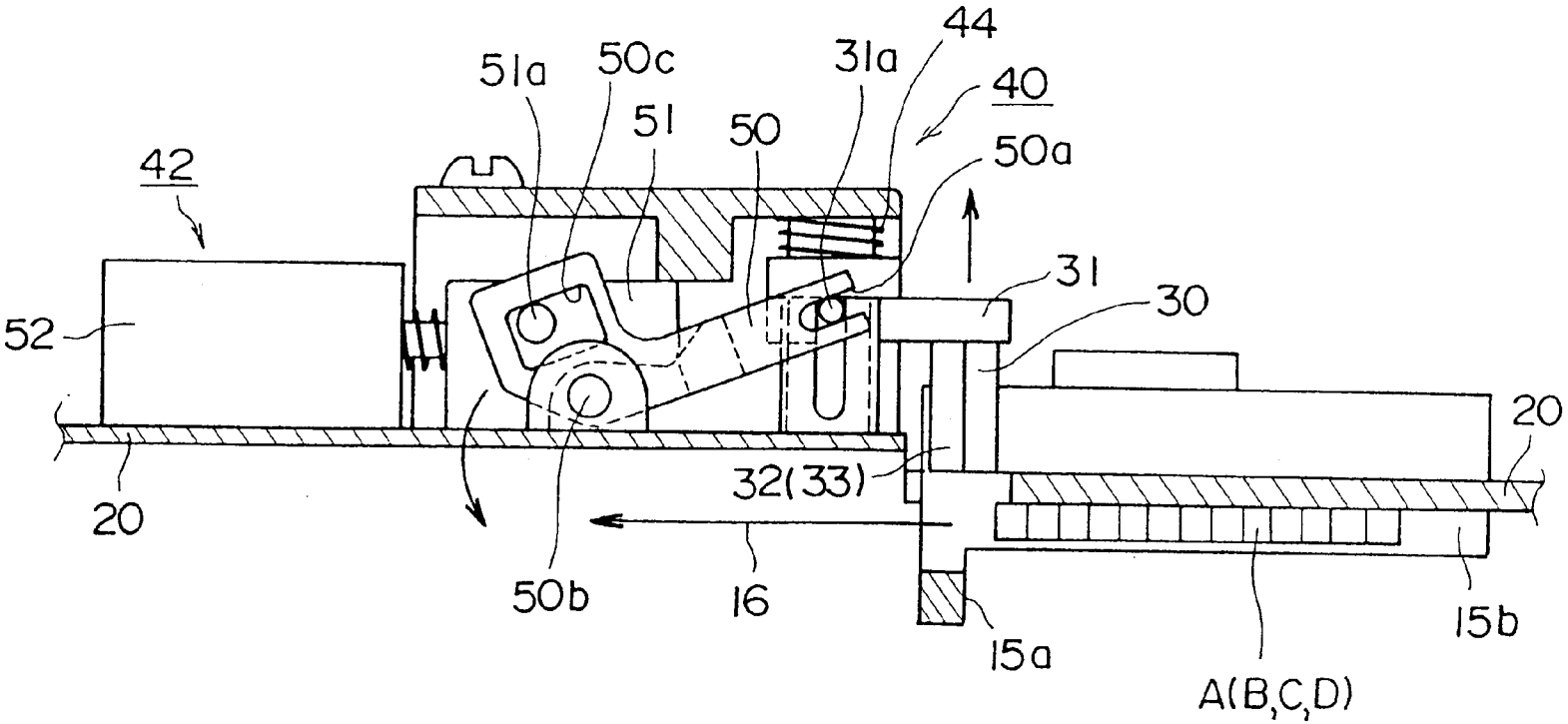
FIG. 8 is an enlarged sectional view of the detaining portion means drive means.

With this kind of detaining portion drive means 40, when the solenoid 52 of link drive means 42 is turned on by means of a drive signal from a control unit (not shown) and slider 51 moves horizontally to the left in the drawing as shown in FIG. 8, projection 51*a* of slider 51 becomes engaged by link hole 50*c*, and guide arm 50 is turned in the counterclockwise direction about shaft 50*b*, so that base portion 31 and guide projection 31*a* detained in guide slot 50*a* formed at the fore end of this guide arm 50 rise along cylindrical post 44, thereby retracting the coin detaining lever 30 and the pair of gate holding levers 32, 33 from second coin sorting passage 16 so as to open second coin sorting passage 16.

When, on the basis of a drive signal from a control unit (not shown), the solenoid 52 of link drive means 42 is turned off, base lever 31 descends along cylindrical post 44 towards main plate 20 under the urging force of the coil spring 45 fitted onto cylindrical post 44, as shown in FIG. 7, so that the coin detaining lever 30 and the pair of gate holding levers 32, 33 are projected into second coin sorting passage 16, blocking the upstream end of second coin sorting passage 16.

At the halt position of the slider 51 shown in FIG. 7, the fore end 51*b* of the slider 51 fits between guide projection 54*a* (which projects from the bottom face of cover 54) and guide projection 50*d* of guide arm 50, thereby preventing rotation of the guide arm 50. Therefore, even if an act of vandalism, such as hitting the vending machine, attempts to move the first sorting lever 15 in the direction indicated by arrow I, movement thereof is prevented by the pair of gate holding levers 32, 33 (which abut the back face of the first gate 15*a*), while movement of gate holding levers 32, 33 is prevented by the restricted rotation of the guide arm 50, which moves the base portion 31.

Accordingly, coins (A, B, C, D) temporarily detained by means of the second gate 15*b* of the first denomination separating lever 15 and the coin detaining lever 30 cannot be dislodged through acts of vandalism, such as hitting the vending machine.

Referring now to FIG. 2, a second denomination separating lever 60 (second denomination separating portion) for separating coins of the A/C group transferred to the second coin sorting passage 16 into coins A and coins C is situated at the downstream end of the second coin sorting passage 16.

Second coin sorting passage 16 is divided by means of this second denomination separating lever 60 into a fourth coin sorting passage 61 for guiding coins A only, and a fifth coin sorting passage 62 for guiding coins C only.

This second denomination separating lever 60 is a denomination separating lever of a type that opens and closes at the right end 60*b* thereof in a direction perpendicular to the plane of the drawing about a shaft 60*a* situated at left end thereof.

As shown in FIG. 2, at the downstream end of the third coin sorting passage 17 there is situated a third denomination separating lever 65 (third denomination separating portion) formed on the back face of main plate 20, for distributing coins to a sixth coin sorting passage 63 (which leads to a cashbox (not shown)) and a seventh coin sorting passage 64.

By means of this third denomination separating lever 65, in the event that coins of a given denomination collected in the coin accommodation portion 5 (FIG. 1) should overflow, the overflowing coins of that denomination are separated and guided to the sixth coin sorting passage 63, which leads to the cashbox, whereas under normal circumstances in which coins collected in the coin accommodation portion 5 (FIG. 1) are not overflowing, coins of group B/D having passed through the third coin sorting passage 17 are separated and guided to the seventh coin sorting passage 64.

This third denomination separating lever 65 is also a denomination separating lever of a type that opens and closes in a direction perpendicular to the plane of the drawing about a shaft 65*a* at its bottom end.

As shown in FIG. 2, a fourth denomination separating lever 66 (fourth denomination separating portion) for separating coins of the B/D group guided into the seventh coin sorting passage 64 into coins B and coins D is situated at the downstream end of the seventh coin sorting passage 64. The seventh coin sorting passage 64 is divided by means of this fourth denomination separating lever 66 into an eighth coin sorting passage 67 (sloping leftward in the drawing) for guiding coins B only, and a ninth coin sorting passage 68 for guiding coins D only, formed on the back face of the main plate 20. This fourth denomination separating lever 66 is also a denomination separating lever of a type that opens and closes in a direction perpendicular to the plane of the drawing about a shaft 66*a* at its bottom end.

As shown in FIG. 2, at the downstream end of the fourth coin sorting passage 61 is situated a fifth denomination separating lever 71 (fifth denomination separating portion) for dividing coins passing through the fourth coin sorting passage 61 into a tenth coin sorting passage 69 for guiding only coins A and an eleventh coin sorting passage 70 that also communicates with a counterfeit coin ejection chute, described later, communicating with the counterfeit coin ejection coin passage 13 mentioned earlier.

This fifth denomination separating lever 71 is also a denomination separating lever of a type that opens and closes in a direction perpendicular to the plane of the drawing about a shaft 71*a* at its bottom end.

The genuine/counterfeit separating lever 12 and the first through fifth denomination separating levers (15, 60, 65, 66, 70) are opened and closed by means of solenoids (not shown) known in the art.

A coin tube (not shown) for accommodating coins D is situated at the downstream end of the ninth coin sorting passage 68, a coin tube (not shown) for accommodating coins B is situated at the downstream end of the eighth coin sorting passage 67, a coin tube (not shown) for accommodating coins C is situated at the downstream end of the fifth coin sorting passage 62, and a coin tube (not shown) for accommodating coins A is situated at the downstream end of the tenth coin sorting passage 69.

The operation and constitution of the coin processing device 1 are now described in greater detail.

In the following description, the temporary holding of a coin A which is deemed genuine is described as an example of the temporary holding function of coin processing device 1.

Figure 9:
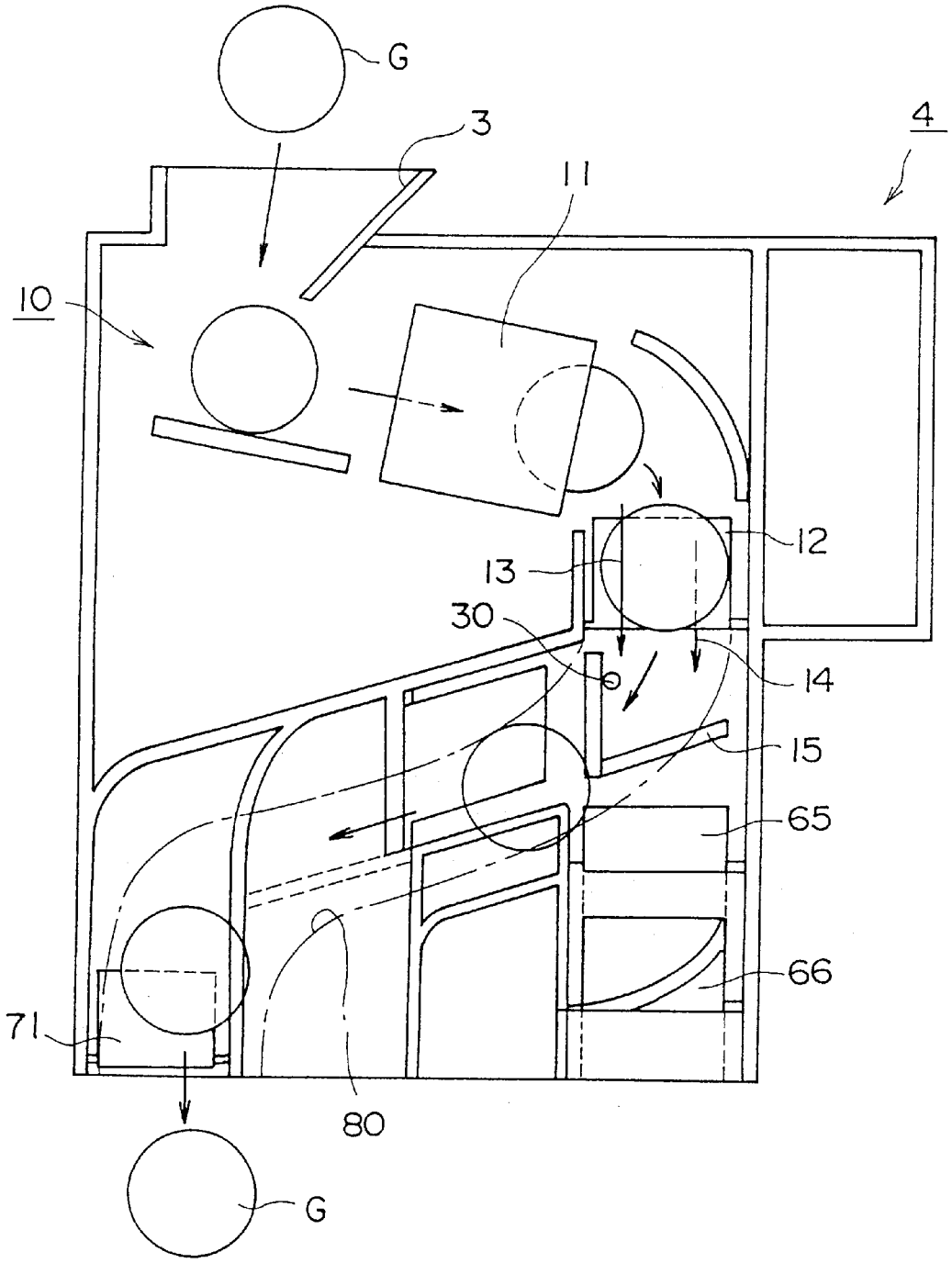
FIG. 9 is a schematic front view of the coin sorting portion showing the processing of a counterfeit coin.

Referring to FIG. 9, wherein parts corresponding with those in FIG. 2 have been assigned the same reference numerals or symbols, once a coin G inserted into a coin insertion slot 3 has been determined to be counterfeit on the basis of a sensor signal from a genuine/counterfeit identifying sensor 11, a genuine/counterfeit coin separating lever 12 opens a counterfeit coin ejection coin passage 13 while at the same time blocking the upstream end of the first coin sorting passage 14.

The counterfeit coin G rolling through a genuine/counterfeit coin identifying passage 10 is guided into counterfeit coin ejection coin passage 13 by genuine/counterfeit coin separating lever 12, and is returned to a coin return slot (not shown) via a counterfeit coin ejection chute 80 formed on the front face of coin sorting portion 4 and communicating with this counterfeit coin ejection coin passage 13.

Figure 10:
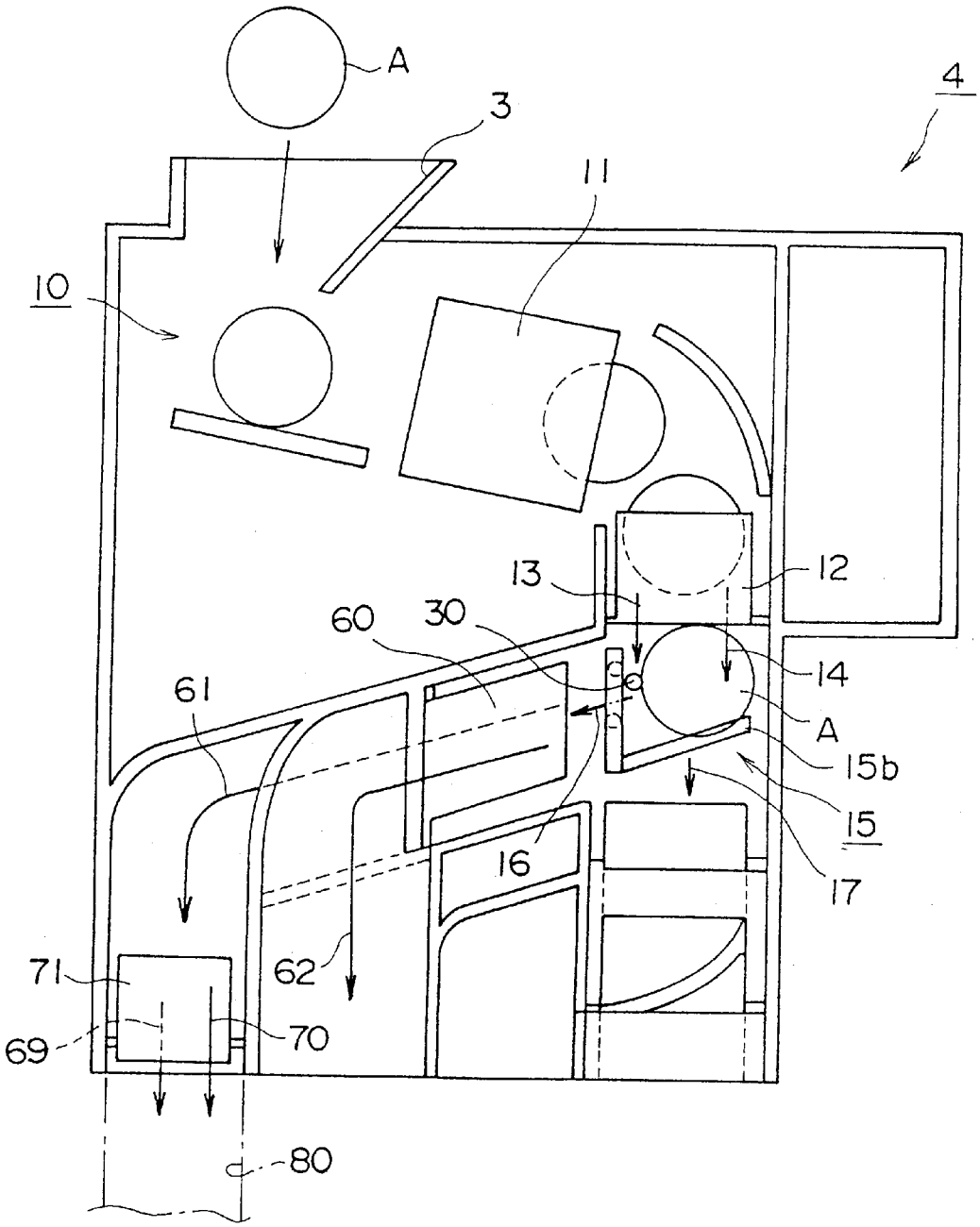
FIG. 10 is a schematic front view of the coin sorting portion showing the processing of a temporarily detained coin A.

Referring to FIG. 10, wherein parts corresponding with those in FIG. 2 have been assigned the same reference numerals or symbols, when a coin has been inserted into coin insertion slot 3 and the coin has been determined on the basis of a sensor signal from genuine/counterfeit identifying sensor 11 to be a genuine coin and moreover to be a coin A, a control unit (not shown), acting on the basis of this determination signal, operates the genuine/counterfeit coin separating lever 12 so as to block the upstream end of the counterfeit coin ejection coin passage 13 and open the upstream end of the first coin sorting passage 14.

At the same time, the first denomination separating lever 15 opens the upstream end of the second coin sorting passage 16 and blocks the upstream end of the third coin sorting passage 17. The second denomination separating lever 60 opens the fourth coin sorting passage 61 and blocks the fifth coin sorting passage 62.

Once determined to be a coin A on the basis of the sensor signal from genuine/counterfeit identifying sensor 11, the control unit (not shown), acting on the basis of this sensor signal, turns off the solenoid 52 of link drive means 42, as a result of which a coin detaining lever 30 and a pair of gate holding levers 32, 33 under the urging force of a coil spring 45 are protruded into second coin sorting passage 16 so as to block the upstream end of second coin sorting passage 16, as shown in FIG. 7.

Thereafter, as shown in FIG. 10, when the downstream end of the first coin sorting passage 14 is reached, the progress of the coin A inserted into coin insertion slot 3 is halted by the second gate 15*b* of first denomination separating lever 15 and the coin detaining lever 30 so as to be temporarily detained at the terminus of the first coin sorting passage 14.

As shown in FIG. 2, a pass sensor 100 for sensing coin passage is situated at the terminus of the first coin sorting passage 14, thereby allowing for reliable detection of whether a coin is being temporarily detained at the terminus of the first coin sorting passage 14.

In a vending machine equipped with the coin processing device 1 described hereinabove, if the coin return lever is operated without a product purchase, the control unit (not shown), acting on the basis of a control signal from this coin return lever, turns on the solenoid 52 of link drive means 42. As a result, the coin detaining lever 30 and the pair of gate holding levers 32, 33 are retracted from the second coin sorting passage 16 as shown in FIG. 8 so that the upstream end of the second coin sorting passage 16 is opened. At the same time, the fifth denomination separating lever 71 shown in FIG. 10 is driven so that the upstream end of the tenth coin sorting passage 69 is blocked and the upstream end of the eleventh coin sorting passage 70, which communicates with counterfeit coin ejection chute 80 (FIG. 9), is opened.

Figure 11:
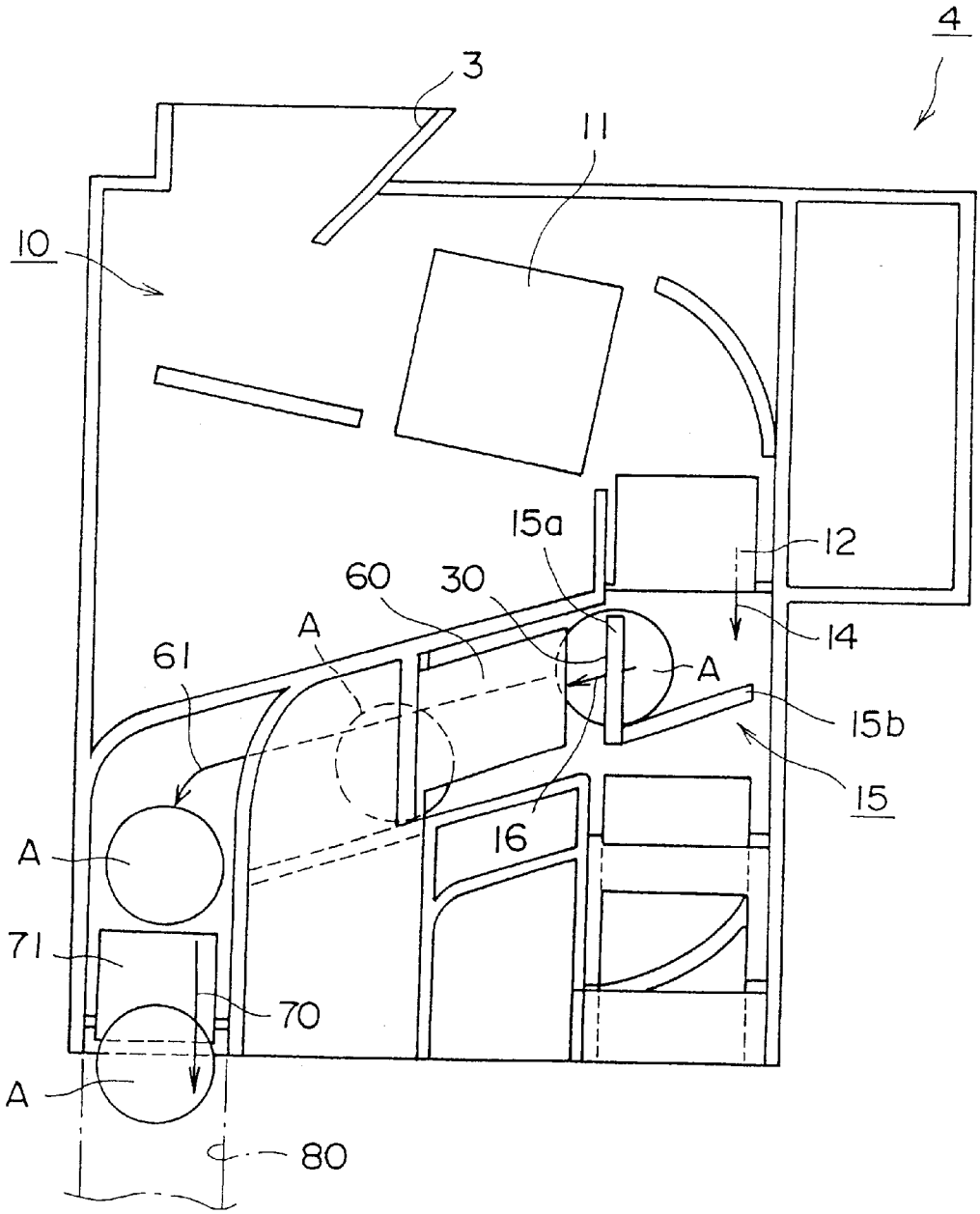
FIG. 11 is a schematic front view of the coin sorting portion showing the processing of a temporarily detained coin A.

Thereafter, as shown in FIG. 11, the coin A temporarily detained at the terminus of the first coin sorting passage 14 now passes through the first gate 15*a* of the first denomination separating lever 15 and is transferred to the second coin sorting passage 16, and is then transferred by the second denomination separating lever 60 to the fourth coin sorting passage 61. The coin A, having been transferred to the third coin sorting passage 61, is then separated to the eleventh coin sorting passage 70 by the fifth denomination separating lever 71, ejected via the eleventh coin sorting passage 70 into the counterfeit coin ejection chute 80, and then returned to the coin return slot (not shown) situated at the terminus of the counterfeit coin ejection chute 80.

Thus, with this coin processing device 1 as well, when the coin return lever is operated without a product purchase in order to return a coin A, the inserted coin that has been actually inserted, namely, the temporarily detained coin A, is dispensed to the coin return slot, so in the event that a counterfeit coin good enough to pass as genuine in the coin sorting portion 4 has been inserted, since the inserted (counterfeit) coin itself is returned to the coin return slot, coin switching is effectively thwarted.

When a product is purchased during the time interval that the coin A shown in FIG. 10 is temporarily detained, the control unit (not shown) turns on the solenoid 52 of link drive means 42 on the basis of a product purchase signal. As a result, the coin detaining lever 30 and the pair of gate holding levers 32, 33 are retracted from the second coin sorting passage 16 as shown in FIG. 8 so that the upstream end of the second coin sorting passage 16 is opened. At the same time the fifth denomination separating lever 71 shown in FIG. 2 is driven so that the upstream end of the tenth coin sorting passage 69 is opened and the upstream end of the eleventh coin sorting passage 70, which communicates with counterfeit coin ejection chute 80, is blocked.

Figure 12:
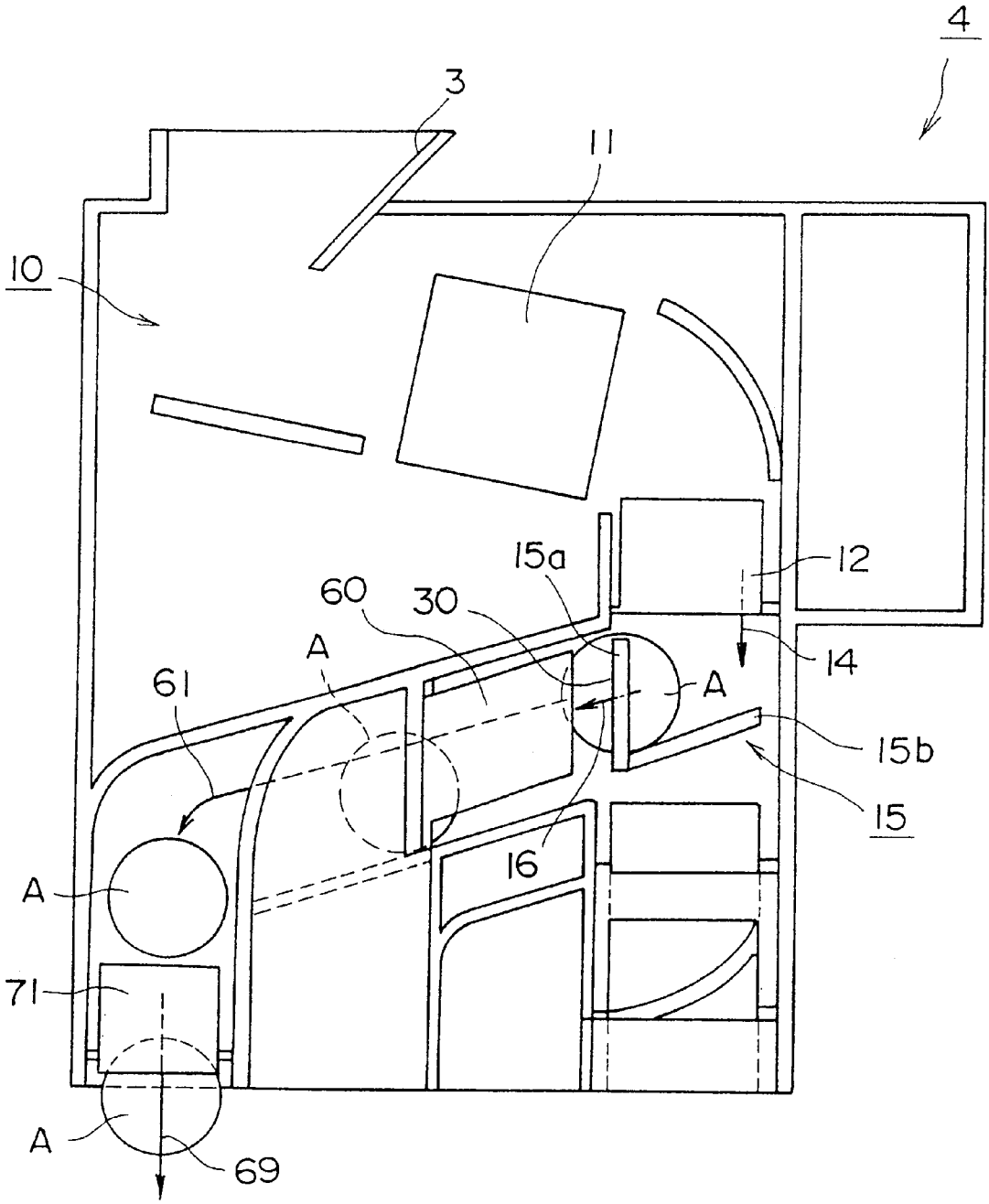
FIG. 12 is a schematic front view of the coin sorting portion showing the processing of a temporarily detained coin A.

Thereafter, as shown in FIG. 12, the coin A temporarily detained at the terminus of the first coin sorting passage 14 now passes through the first gate 15*a* of the first denomination separating lever 15 and is transferred to the second coin sorting passage 16, and is then transferred by the second denomination separating lever 60 into the fourth coin sorting passage 61.

The coin A, having been transferred to the fourth coin sorting passage 61, is then separated to the tenth coin sorting passage 69 by the fifth denomination separating lever 71, and is placed in a coin tube for exclusive use of coins A (not shown) situated below the tenth coin sorting passage 69.

Where change is due from a purchase, the required change is dispensed to the coin return slot from the coin accommodating portion 5 by a coin dispensing portion 6 (FIG. 1).

Figure 13:
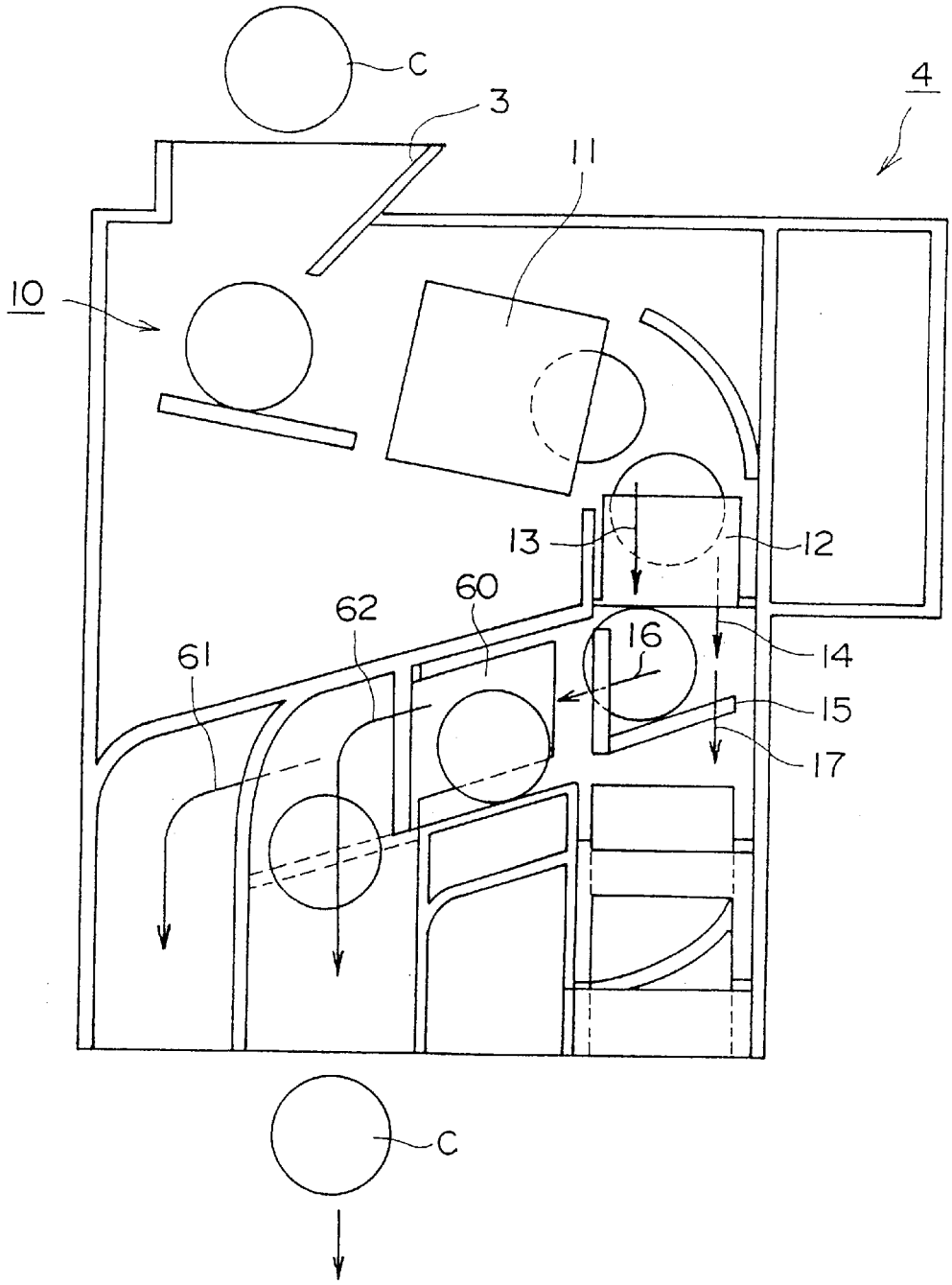
FIG. 13 is a schematic front view of the coin sorting portion showing the processing of a coin C.

Referring now to FIG. 13, wherein parts corresponding with those in FIG. 2 have been assigned the reference numerals or symbols, when a coin has been inserted into coin insertion slot 3 and the coin has been determined to be a coin C on the basis of a signal from genuine/counterfeit identifying sensor 11, a control unit (not shown), acting on the basis of this determination signal, operates the genuine/counterfeit coin separating lever 12 so as to block the upstream end of the counterfeit coin ejection coin passage 13 and open the upstream end of the first coin sorting passage 14.

At the same time, the first denomination separating lever 15 is operated to open the upstream end of the second coin sorting passage 16 and block the upstream end of the third coin sorting passage 17. The second denomination separating lever 60 operates to block the fourth coin sorting passage 61 and open the fifth coin sorting passage 62.

Once determined to be a coin C on the basis of the sensor signal from genuine/counterfeit identifying sensor 11, a control unit (not shown), acting on the basis of this sensor signal, turns on the solenoid 52 of link drive means 42, as a result of which the coin detaining lever 30 and the pair of gate holding levers 32, 33 are retracted from the second coin sorting passage 16 so as to open the upstream end of second coin sorting passage 16, as shown in FIG. 8.

Thereafter, as shown in FIG. 13, the coin C rolling through genuine/counterfeit coin identifying passage 10 is guided into the first coin sorting passage 14 by the genuine/counterfeit coin separating lever 12, the coin C guided into the first coin sorting passage 14 is then guided by the first denomination separating lever 15 into the inclined second coin sorting passage 16, the coin C guided into the second coin sorting passage 16 is then guided by the second denomination separating lever 60 into a fifth coin sorting passage 62, and then drops from the bottom thereof and is collected in a coin tube for exclusive use of coins C.

Figure 14:
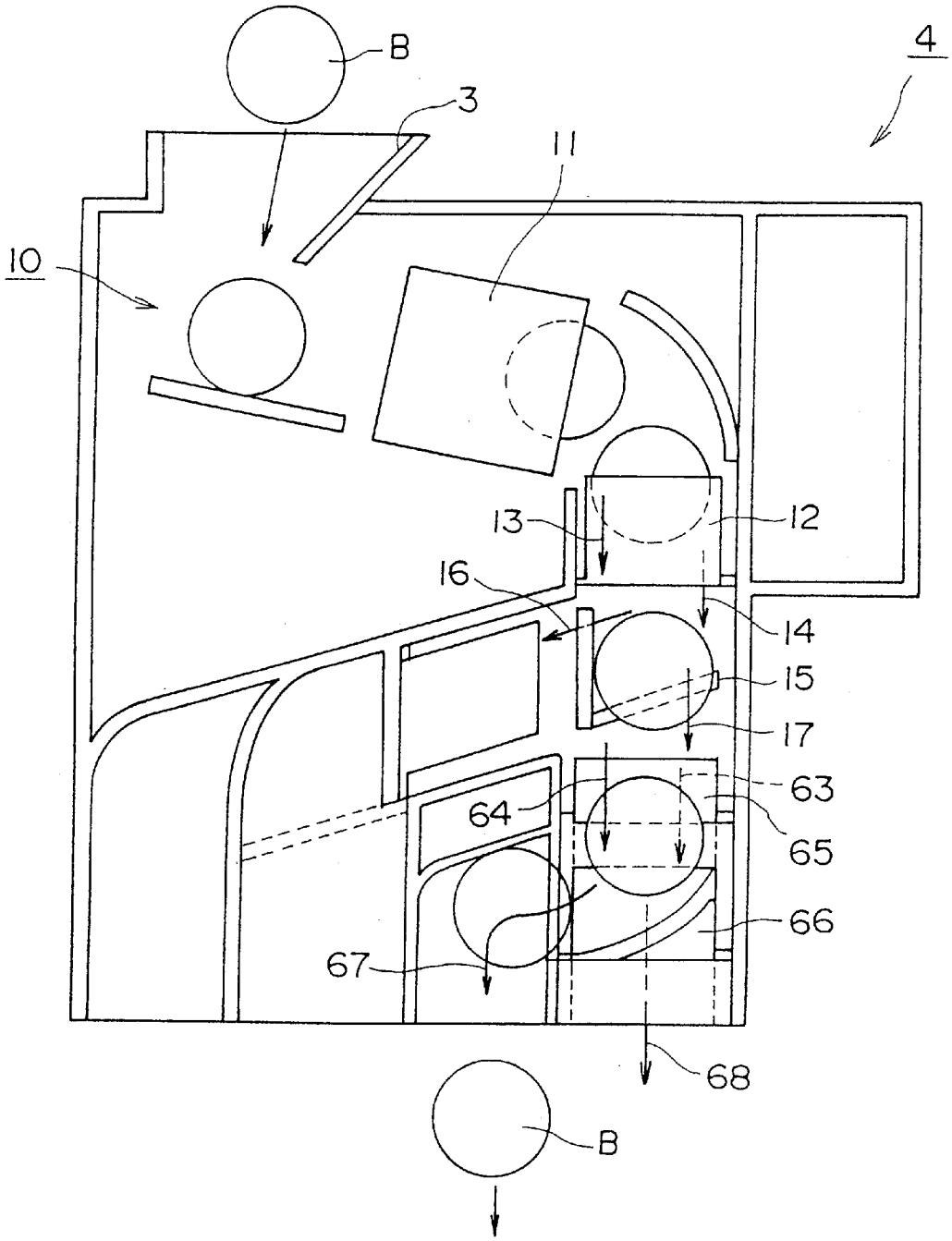
FIG. 14 is a schematic front view of the coin sorting portion showing the processing of a coin B.

Referring now to FIG. 14, wherein parts corresponding with those in FIG. 2 have been assigned the same reference numerals or symbols, when a coin has been inserted into coin insertion slot 3 and the coin has been determined to be a coin B on the basis of a sensor signal from genuine/counterfeit identifying sensor 11, a control unit (not shown), acting on the basis of this determination signal, operates the genuine/counterfeit coin separating lever 12 so as to block the upstream end of the counterfeit coin ejection coin passage 13 and open the upstream end of the first coin sorting passage 14. At the same time, operating the first denomination separating lever 15 to block the upstream end of the second coin sorting passage 16 and open the upstream end of the third coin sorting passage 17. At the same time, during operation of the first denomination separating lever 15 the control unit (not shown) turns on the solenoid 52 of link drive means 42. As a result, the coin detaining lever 30 and the pair of gate holding levers 32, 33 are retracted from the second coin sorting passage 16, as shown in FIG. 8.

At the same time, the control unit (not shown) operates the third denomination separating lever 65 to block the upstream end of the sixth coin sorting passage 63 and open the upstream end of the seventh coin sorting passage 64, while at the same time operating the fourth denomination separating lever 66 to open the upstream end of the eighth coin sorting passage 67 and block the upstream end of the ninth coin sorting passage 68.

Thereafter, as shown in FIG. 14, the coin B rolling through genuine/counterfeit coin identifying passage 10 is guided into the first coin sorting passage 14 by the genuine/counterfeit coin separating lever 12, the coin B guided into the first coin sorting passage 14 is then guided by the first denomination separating lever 15 into a third coin sorting passage 17 situated below, the coin B guided into the third coin sorting passage 17 is then guided by the third denomination separating lever 65 into a seventh coin sorting passage 64, the coin B guided into the seventh coin sorting passage 64 is then guided by the fourth denomination separating lever 66 into an eighth coin sorting passage 67, and then drops from the bottom thereof and is collected in a coin tube for exclusive use of coins B.

Figure 15:
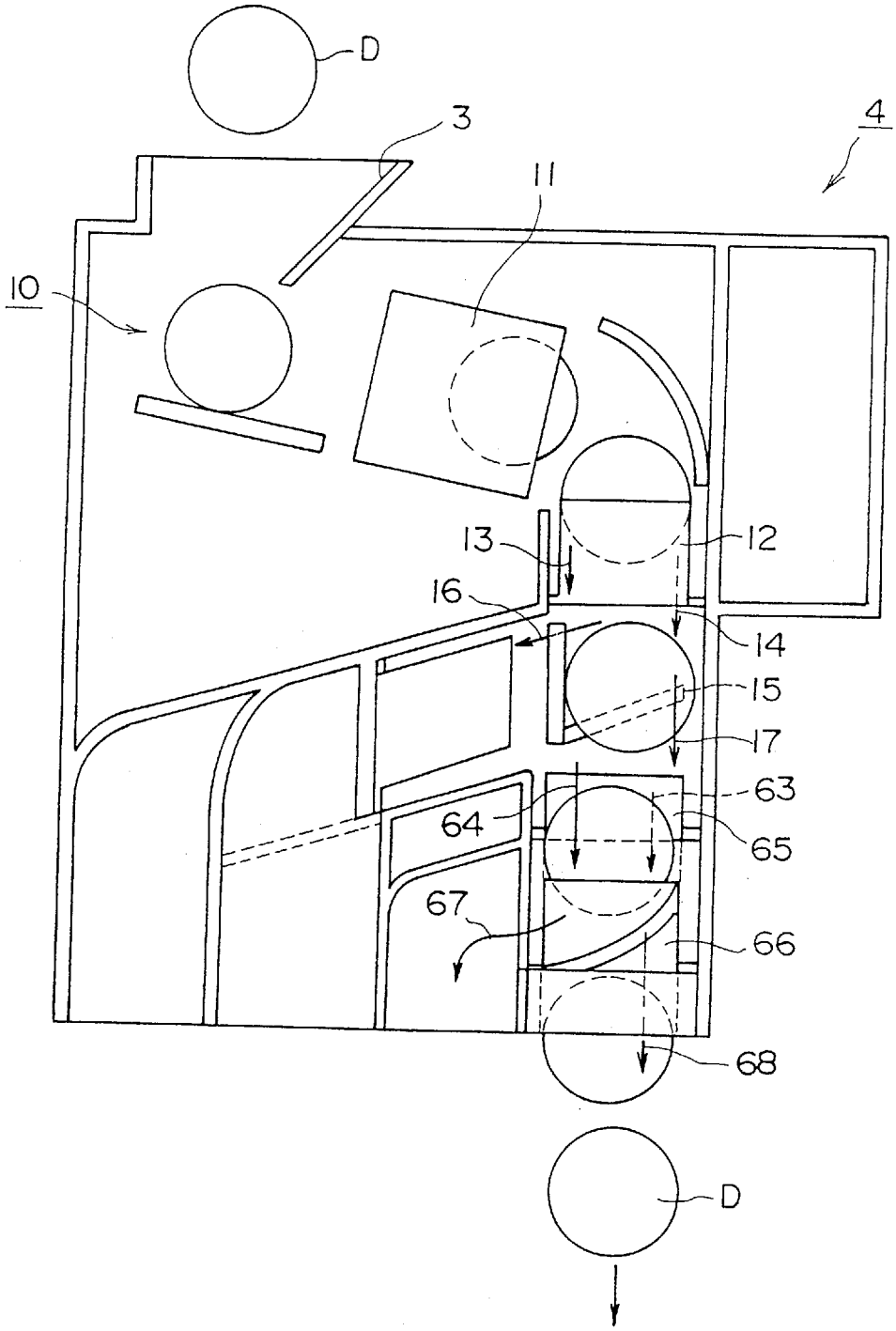
FIG. 15 is a schematic front view of the coin sorting portion showing the processing of a coin D.

Referring now to FIG. 15, wherein parts corresponding with those in FIG. 2 have been assigned the same reference numerals or symbols, when a coin has been inserted into coin insertion slot 3 and the coin has been determined to be a coin D on the basis of a sensor signal from genuine/counterfeit identifying sensor 11, a control unit (not shown), acting on the basis of this determination signal, operates the genuine/counterfeit coin separating lever 12 so as to block the upstream end of the counterfeit coin ejection coin passage 13 and open the upstream end of the first coin sorting passage 14, while at the same time operating the first denomination separating lever 15 to open the upstream end of the third coin sorting passage 17 and block the upstream end of the second coin sorting passage 16. At the same time, during operation of the first denomination separating lever 15 the control unit (not shown) turns on the solenoid 52 of link drive means 42. As a result, the coin detaining lever 30 and the pair of gate holding levers 32, 33 are retracted from the second coin sorting passage 16, as shown in FIG. 8.

At the same time, the control unit (not shown) operates the third denomination separating lever 65 to open the upstream end of the seventh coin sorting passage 64 and block the upstream end of the sixth coin sorting passage 63. At the same time, it operates the fourth denomination separating lever 66 to block the upstream end of the eighth coin sorting passage 67 and open the upstream end of the ninth coin sorting passage 68.

Thereafter, as shown in FIG. 15, the coin D rolling through genuine/counterfeit coin identifying passage 10 is guided into the first coin sorting passage 14 by the genuine/counterfeit coin separating lever 12. The coin D guided into the first coin sorting passage 14 is then guided by the first denomination separating lever 15 into the third coin sorting passage 17 situated below. The coin D guided into the third coin sorting passage 17 is then guided by a third denomination separating lever 65 into the seventh coin sorting passage 64. The coin D guided into the seventh coin sorting passage 64 is then guided by the fourth denomination separating lever 66 into the ninth coin sorting passage 68, and then drops from the bottom thereof and is collected in a coin tube for exclusive use of coins D.

By means of the four coin sorting operations described above, A, B, C, and coins D are sorted, and in this way A; B, C, and coins D are sequentially collected and accommodated within the dedicated coin tubes that make up the coin accommodation portion.

When the number of coins in a coin tube exceeds a predetermined number accommodatable therein, an overflow condition results.

With the coin processing device 1 of this embodiment, overflow detection means of a type known in the art, provided to each dedicated coin tube, detect when the number of coins accommodated within an individual dedicated coin tube reaches a predetermined number, and when an inserted coin representing overflow is subsequently inserted, this coin is sent directly to the cashbox (excluding coins A detained temporarily).

Let it be assumed, for example, that the overflow. detection means (not shown) has detected that the number of coins collected and accommodated in the coin tube for exclusive use of coins B has reached a predetermined number. The aforementioned coin sorting portion 4 performs the following sorting operation.

Figure 16:
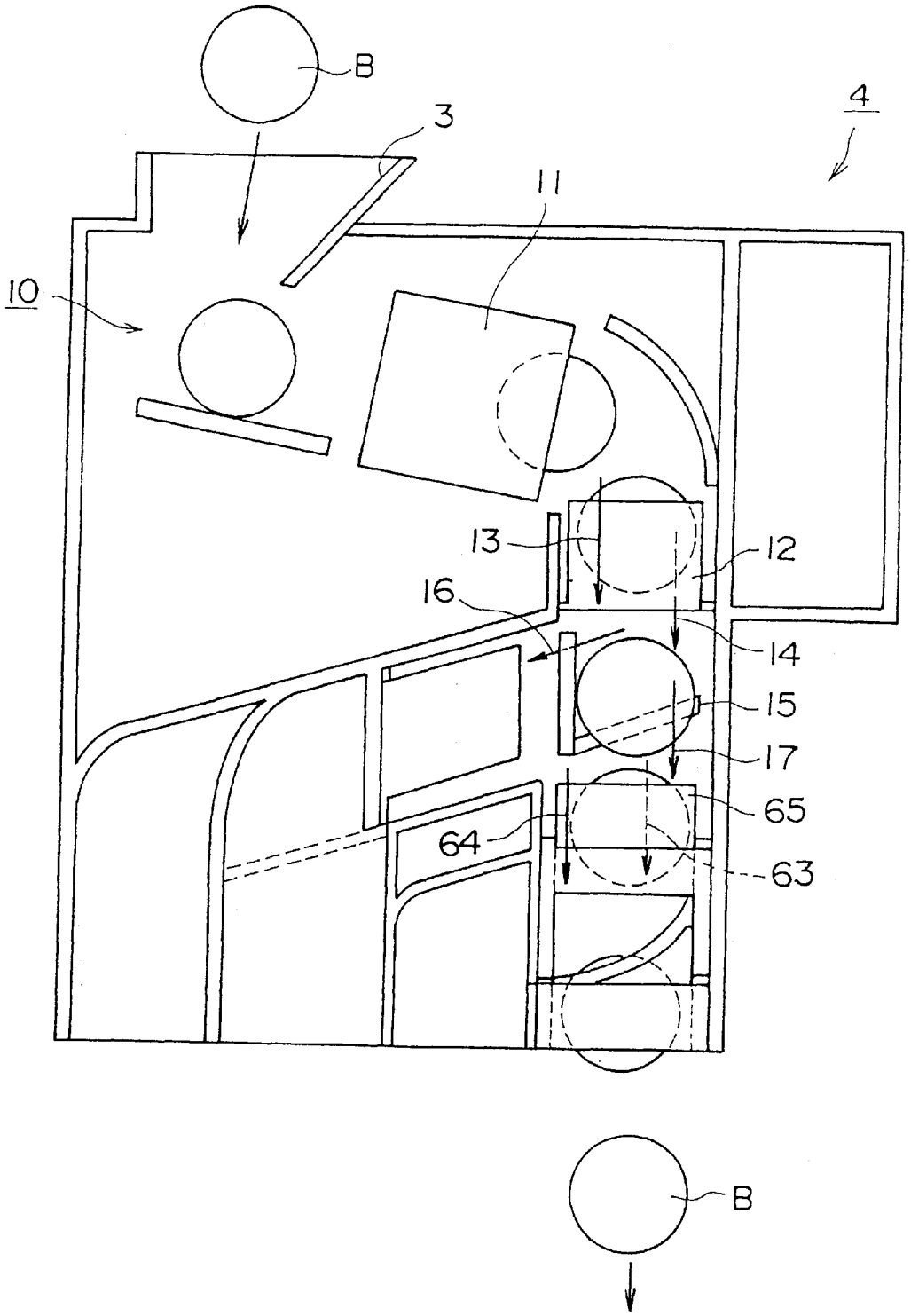
FIG. 16 is a schematic front view of the coin sorting portion showing the processing of a coin B.

Referring now to FIG. 16, wherein parts corresponding with those in FIG. 2 have been assigned the same reference numerals or symbols, when a coin has been inserted into coin insertion slot 3 and the coin has been determined to be a coin B on the basis of a sensor signal from genuine/counterfeit identifying sensor 11, and the overflow detection means (not shown) has detected that the number of coins B accommodated in the dedicated coin tube of the coin accommodation portion has reached a predetermined number, a control unit (not shown), acting on the basis of this determination signal, operates the genuine/counterfeit coin separating lever 12 so as to block the upstream end of the counterfeit coin ejection coin passage 13 and open the upstream end of the first coin sorting passage 14, while at the same time operating the first denomination separating lever 15 to open the upstream end of the third coin sorting passage 17 and block the upstream end of the second coin sorting passage 16. At the same time, during operation of the first denomination separating lever 15 the control unit (not shown) turns on the solenoid 52 of link drive means 42, as a result of which the coin detaining lever 30 and the pair of gate holding levers 32, 33 are retracted from the second coin sorting passage 16, as shown in FIG. 8.

At the same time, the control unit operates the third denomination separating lever 65 to open the upstream end of the sixth coin sorting passage 63 and block the upstream end of the seventh coin sorting passage 64.

Thereafter, as shown in FIG. 16, the coin B rolling through genuine/counterfeit coin identifying passage 10 is guided into the first coin sorting passage 14 by the genuine/counterfeit coin separating lever 12, and the coin B guided into the first coin sorting passage 14 is then guided by the first denomination separating lever 15 into the third coin sorting passage 17 situated below. The coin B guided into the third coin sorting passage 17 is then guided by a third denomination separating lever 65 into the sixth coin sorting passage 63, and the coin B guided into the sixth coin sorting passage 63 then drops from the bottom thereof and is sent directly to the cashbox (not shown) situated at the bottom of the processing device 1 via a chute (not shown) that communicates with the sixth coin sorting passage 63.

The same above-described coin sorting process performed by the coin sorting portion 4 during overflow is the same for all other coins (excluding coins A detained temporarily) whose number has been determined to have reached a predetermined number by the overflow detection sensor.

Let it be assumed, for example, that the overflow detection means (not shown) has detected that the number of coins A collected and accommodated in the coin tube for exclusive use of coins A to be detained temporarily has reached a predetermined number. The aforementioned coin sorting portion 4 performs the following sorting operation.

Referring to FIG. 10, when a coin has been inserted into coin insertion slot 3 and the coin has been determined on the basis of a sensor signal from genuine/counterfeit identifying sensor 11 to be a coin A, and the overflow detection means has detected that the number of coins A accommodated in the dedicated coin tube of the coin accommodation portion has reached a predetermined number, a control unit (not shown), acting on the basis of this determination signal, operates the genuine/counterfeit coin separating lever 12 so as to block the upstream end of the counterfeit coin ejection coin passage 13 and open the upstream end of the first coin sorting passage 14.

At the same time, it operates the first denomination separating lever 15 to open the upstream end of the second coin sorting passage 16 and block the upstream end of the third coin sorting passage 17. It also operates the second denomination separating lever 60 to open the fourth coin sorting passage 61 and block the fifth coin sorting passage 62.

The control unit (not shown) turns off the solenoid 52 of link drive means 42, as a result of which the coin detaining lever 30 and the pair of gate holding levers 32, 33 under the urging force of the coil spring 45 are protruded into second coin sorting passage 16 so as to block the upstream end of second coin sorting passage 16, as shown in FIG. 7.

Thereafter, as shown in FIG. 10, the downstream end of the first coin sorting passage 14 is reached, the progress of the coin A inserted into coin insertion slot 3 is halted by the second gate 15*b* of first denomination separating lever 15 and the coin detaining lever 30 so as to be temporarily detained at the terminus of the first coin sorting passage 14.

In other words, with the coin sorting portion 4 described above, even in the case that the overflow detection means has detected that the number of coins A accommodated in the dedicated coin tube of the coin accommodation portion has reached a predetermined number, inserted coins A are not guided directly to the cashbox, but rather temporarily detained at the terminus of the first coin sorting passage 14.

In a vending machine equipped with the coin processing device 1 described above, in the event that the coin return lever is subsequently operated without a product purchase, a control unit (not shown), acting on the basis of a control signal from this coin return lever, turns on the solenoid 52 of link drive means 42, as a result of which the coin detaining lever 30 and the pair of gate holding levers 32, 33 are retracted from the second coin sorting passage 16, as shown in FIG. 8, so that the upstream end of the second coin sorting passage 16 is opened, while at the same time the fifth denomination separating lever 71 is driven so that the upstream end of the tenth coin sorting passage 69 is blocked and the upstream end of the eleventh coin sorting passage 70, which communicates with counterfeit coin ejection chute 80 (FIG. 9), is opened.

Thereafter, as shown in FIG. 11, the coin A temporarily detained at the terminus of the first coin sorting passage 14 now passes through the first gate 15*a* of the first denomination separating lever 15 and is transferred to the second coin sorting passage 16, and is then transferred by the second denomination separating lever 60 to the fourth coin sorting passage 61. Coin A, having been transferred to the fourth coin sorting passage 61, is then separated to the eleventh coin sorting passage 70 by the fifth denomination separating lever 71, ejected via the eleventh coin sorting passage 70 into the counterfeit coin ejection chute 80, and then returned to the coin return slot (not shown) situated at the terminus of the counterfeit coin ejection chute 80.

Thus, even when an additional coin A is inserted after the number of coins A accommodated in the dedicated coin tube therefor has reached a predetermined number, if the coin return lever should be operated without a product purchase in order to return the inserted coin, the inserted coin that has been actually inserted, namely, the temporarily detained coin A, is dispensed to the coin return slot, so in the event that a counterfeit coin A good enough to pass as genuine in the coin sorting portion has been inserted after overflow has been reached, since the inserted (counterfeit) coin A itself is returned to the coin return slot, coin switching is effectively thwarted.

Figure 17:
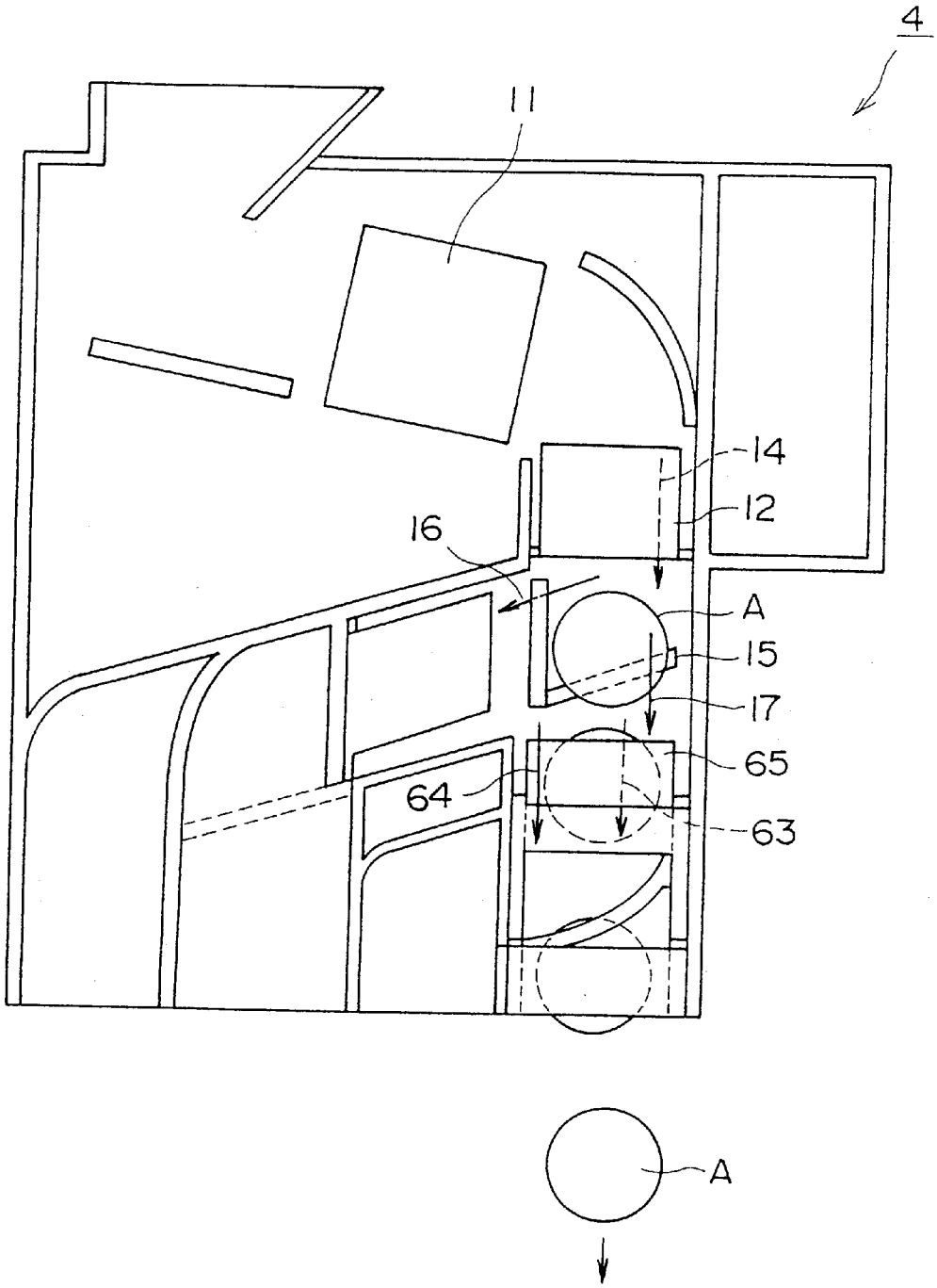
FIG. 17 is a suggestion of the coin sorting portion showing the processing of a temporarily detained coin A during overflow.

When a product is purchased during the time interval that the coin A shown in FIG. 10 is temporarily detained, the control unit (not shown), on the basis of a product purchase signal, operates the first denomination separating lever 15 to open the upstream end of the third coin sorting passage 17 and block the upstream end of the second coin sorting passage 16, as shown in FIG. 17, wherein parts corresponding with those in FIG. 16 have been assigned the same reference numerals or symbols. At the same time, during operation of the first denomination separating lever 15, the control unit (not shown) turns on the solenoid 52 of link drive means 42, as a result of which the coin detaining lever 30 and the pair of gate holding levers 32, 33 are retracted from the second coin sorting passage 16, as shown in FIG. 8.

At the same time, the control unit operates the third denomination separating lever 65, so that the upstream end of the sixth coin sorting passage 63 is opened and the upstream end of the seventh coin sorting passage 64 is blocked.

Thereafter, as shown in FIG. 17, the coin A temporarily detained at the terminus of the first coin sorting passage 14 is guided by the first denomination separating lever 15 into the third coin sorting passage 17 situated below. The coin A having been guided into the third coin sorting passage 17 is then guided into the sixth coin sorting passage 63 by the third denomination separating lever 65, and the coin A having been guided into the sixth coin sorting passage 63 then drops from the bottom thereof and is sent to the cashbox (not shown) situated at the bottom of the processing device 1 via a chute (not shown) that communicates with the sixth coin sorting passage 63.

Thus, with the constitution described hereinabove, once a product has been purchased, an inserted coin A inserted after the dedicated coin tube therefor has reached overflow is sent to the cashbox (not shown).

While the description of the preceding embodiment relates to the case of temporarily holding coins A as the coin targeted for temporary holding, a coin processing device 1 of the structure described hereinabove may be adapted for temporarily holding coins C as the coin targeted for temporary holding, without any modification whatsoever of the structure thereof.

Figure 18:
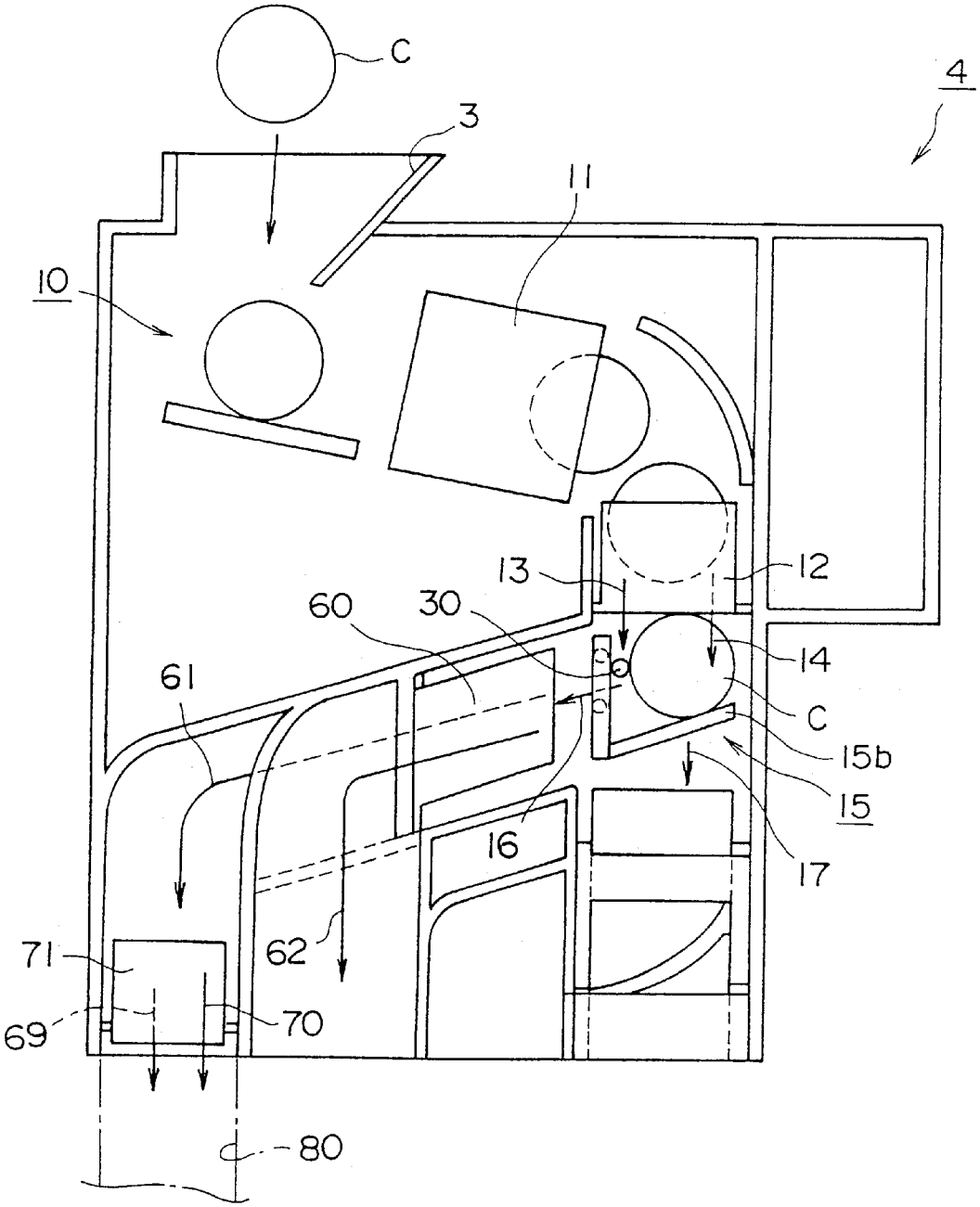
FIG. 18 is a schematic front view of the coin sorting portion showing the processing of a temporarily detained coin C.

Specifically, referring to FIG. 18, wherein parts corresponding with those in FIG. 10 have been assigned the same reference numerals or symbols, where it is desired to temporarily hold coins C, when a coin has been inserted into coin insertion slot 3 and the coin has been determined on the basis of a sensor signal from genuine/counterfeit identifying sensor 11 to be a genuine coin and moreover to be a coin C, a control unit (not shown), acting on the basis of this determination signal, operates the genuine/counterfeit coin separating lever 12 so as to block the upstream end of the counterfeit coin ejection coin passage 13 and open the upstream end of the first coin sorting passage 14.

The control unit (not shown) also turns Off the solenoid 52 of link drive means 42, as a result of which the coin detaining lever 30 and the pair of gate holding levers 32, 33 under the urging force of the coil spring 45 are protruded into second coin sorting passage 16 so as to block the upstream end of second coin sorting passage 16, as shown in FIG. 7.

Thereafter, as shown in FIG. 18, when the downstream end of the first coin sorting passage 14 is reached, the progress of the coin C inserted into coin insertion slot 3 is halted by the second gate 15*b* of first denomination separating lever 15 and the coin detaining lever 30 so as to be temporarily detained at the terminus of the first coin sorting passage 14.

In a vending machine equipped with the coin processing device 1 described hereinabove, if the coin return lever is operated without a product purchase, the control unit (not shown), acting on the basis of a control signal from this coin return lever, turns on the solenoid 52 of link drive means 42, as a result of which the coin detaining lever 30 and the pair of gate holding levers 32, 33 are retracted from the second coin sorting passage 16 as shown in FIG. 8 so that the upstream end of the second coin sorting passage 16 is opened, while at the same time the fifth denomination separating lever 71 is driven so that the upstream end of the tenth coin sorting passage 69 is blocked and the upstream end of the eleventh coin sorting passage 70, which communicates with counterfeit coin ejection chute 80 (FIG. 9), is opened.

Figure 19:
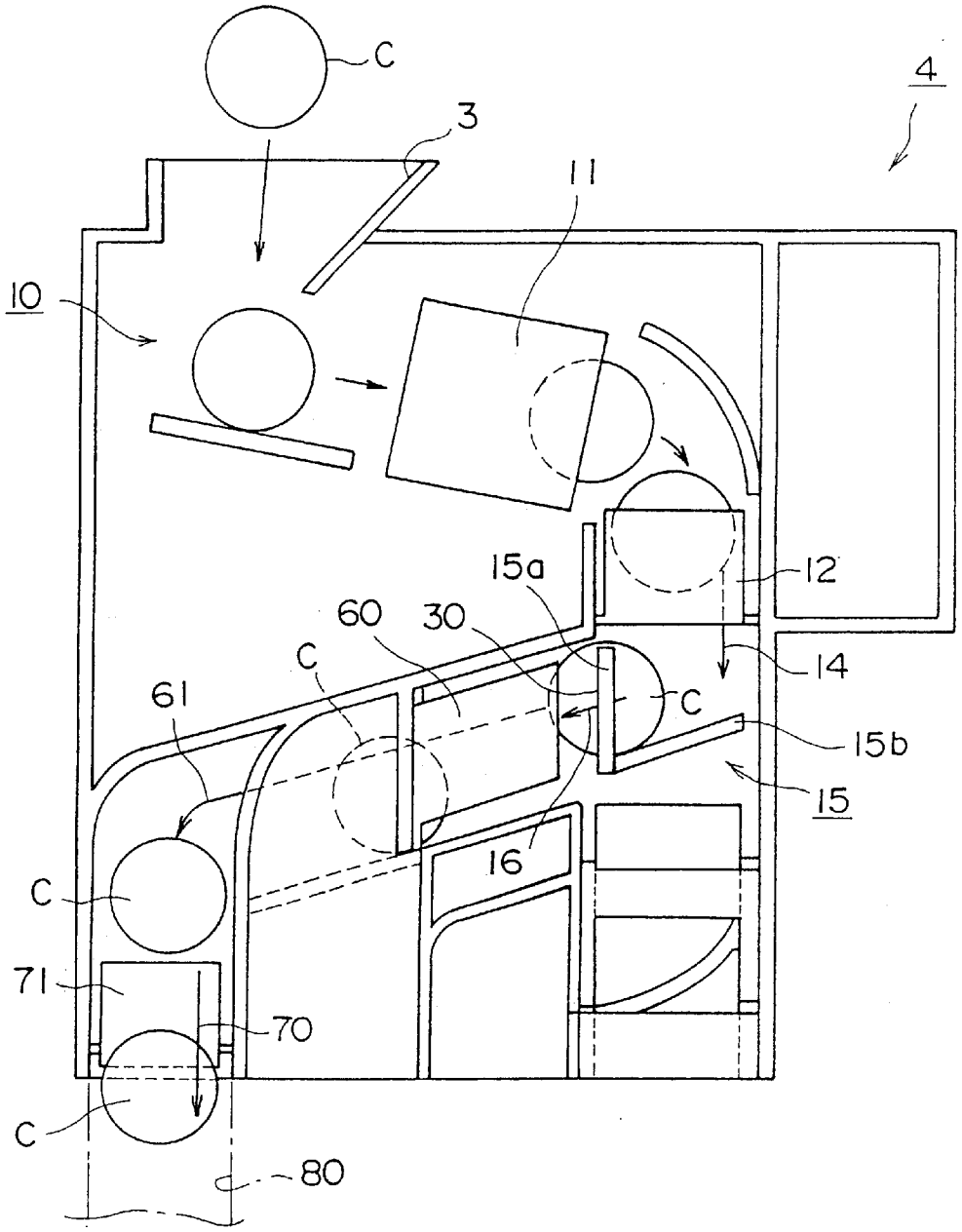
FIG. 19 is a schematic front view of the coin sorting portion showing the processing of a temporarily detained coin C.

Thereafter, as shown in FIG. 19, the coin C temporarily detained at the terminus of the first coin sorting passage 14 now passes through the first gate 15*a* of the first denomination separating lever 15 and is transferred to the second coin sorting passage 16, and is then transferred by the second denomination separating lever 60 to the third coin sorting passage 61. Coin C, having been transferred to the fourth coin sorting passage 61, is then separated to the eleventh coin sorting passage 70 by the fifth denomination separating lever 71, ejected via the eleventh coin sorting passage 70 into the counterfeit coin ejection chute 80, and then returned to the coin return slot (not shown) situated at the terminus of the counterfeit coin ejection chute 80.

Thus, with this coin processing device 1 as well, when the coin return lever is operated without a product purchase in order to return a coin C, the inserted coin that has been actually inserted, namely, the temporarily detained coin C, is dispensed to the coin return slot, so in the event that a counterfeit coin C good enough to pass as genuine in the coin sorting portion has been inserted, since the inserted (counterfeit) coin C itself is returned to the coin return slot, coin switching is effectively thwarted.

On the other hand, when a product is purchased during the time interval that the coin C shown in FIG. 18 is temporarily detained, the control unit (not shown), on the basis of a product purchase signal, operates the first denomination separating lever 15 to block the upstream end of the second coin sorting passage 16 and open the upstream end of the third coin sorting passage 17, as shown in FIG. 13. At the same time, during operation of the first denomination separating lever 15, the control unit (not shown) turns on the solenoid 52 of link drive means 42, so that the coin detaining lever 30 and the pair of gate holding levers 32, 33 are retracted from the second coin sorting passage 16, as shown in FIG.8.

At the same time, the control unit (not shown) operates the third denomination separating lever 65 to block the upstream end of the sixth coin sorting passage 63 and open the upstream end of the seventh coin sorting passage 64, while at the same time operating the fourth denomination separating lever 66 to open the upstream end of the eighth coin sorting passage 67 and block the upstream end of the ninth coin sorting passage 68.

Thereafter, the temporarily detained coin C is guided by the second denomination separating lever 60 into the fifth coin sorting passage 62, as shown in FIG. 13, and then drops from the bottom thereof and is collected in a coin tube for exclusive use of coins C.

Through selection of coins to be held and modification of the settings of the control unit (not shown) to control operation of the corresponding levers, temporary holding of inserted coins in the manner described hereinabove and the subsequent series of coin processes can be adapted for use with any other coin, not just the coins A and coins C described hereinabove.

Accordingly, the coin processing device 1 described hereinabove may be adapted for temporarily holding a plurality of types of inserted coins without any modification whatsoever of the internal structure thereof, simply by modifying the settings of the control unit. When the return lever is operated without a product purchase, the plurality of types of inserted coins temporarily detained may be returned.

According to the coin processing device of the invention set forth hereinabove, a coin detaining portion for temporarily holding inserted coins is situated adjacent to the denomination separating portion situated at the farthest upstream location of coin sorting passages having arranged therein a plurality of denomination separating portions for separating inserted coins identified as genuine into different coin passages on the basis of their denomination, so that even if coins of a plurality of denominations are temporarily detained, the need to provide coin detaining levers in a number corresponding to the number of denominations, as in the conventional art, is obviated, thereby reducing the number of parts and simplifying the lever means and drive control. An inexpensive coin processing device capable of temporarily holding coins of a plurality of denominations is afforded thereby.

Various other embodiments are possible without departing from the spirit and principal features of the invention, and therefore the preceding embodiments are merely illustrative and must not be construed as limiting. The scope of the invention is as recited in the claims and is in no way restricted to the specification. Various alterations and modifications equivalent under the claims fall within the scope of the invention.

What is claimed is:

1. A coin processing device comprising:

a plurality of denomination separating portions arranged in a coin sorting passage, for separating an inserted coin identified as genuine into different coin passages based on a denomination of the coin; and a coin detaining portion arranged in the coin sorting passage, for temporarily detaining the coin moving in one direction along the different coin sorting passages, and then releasing the temporal detention of the coin to allow the coin to immediately move forward in at least the one direction, and wherein the coin detaining portion is situated adjacent to one of the plurality of denomination separating portions arranged in the coin passages, the one of the denomination separating portions being situated at a farther upstream location than any other denomination separating portions.

2. A coin processing device comprising a coin sorting passage in which are arranged a plurality of denomination separating portions for separating inserted coins identified as genuine into different coin passages based on their denomination, and a coin detaining portion for temporarily detaining the inserted coins passing through the coin sorting passages, wherein the coin detaining portion is situated adjacent to one of the plurality of denomination separating portions arranged in the coin sorting passages, the one of the denomination separating portions being situated at a farther upstream location than any other denomination separating portions, and wherein the denomination separating portion situated at the farthest upstream location in the coin sorting passage is a protrudable/retractable lever of "L" configuration viewed overall from a front, comprising a first gate that opens/closes sideways and a second gate that opens/closes a bottom side; and the coin detaining portion is protrudably/retractably situated adjacent to the first gate, and the coin detaining portion and the second gate are protruded in order to temporarily hold an inserted coin by engaging the coin therewith.

3. The coin processing device according to claim 2, further comprising a gate holding portion for supporting the first gate of the denomination separating portion at a back face thereof; and detaining portion drive means for driving protrusion and retraction of the gate holding portion and the coin detaining portion, and for locking protrusion movement when the gate holding portion and the coin detaining portion are protruded.

4. The coin processing device according to claim 3, wherein the coin detaining portion comprises a coin detaining lever of pin configuration protrudably/retractably provided adjacent to the first gate; and the gate holding portion comprises a gate holding lever of pin configuration protrudably/retractably provided adjacent to the coin detaining portion.

5. The coin processing device according to claim 4, wherein the detaining portion drive means comprises:

a base portion for supporting the coin detaining lever and the gate holding lever; and link means for effecting and for locking the protrusion movement of the base portion.

* * * * *